US005388521A

United States Patent [19]

Coursen

[11] Patent Number: 5,388,521

[45] Date of Patent: Feb. 14, 1995

[54] METHOD OF REDUCING GROUND VIBRATION FROM DELAY BLASTING

[75] Inventor: David L. Coursen, Espanola, N. Mex.

[73] Assignee: Coursen Family Trust, Espanola, N. Mex. ; D. Linn Coursen, trustee

[21] Appl. No.: 137,562

[22] Filed: Oct. 18, 1993

[51] Int. Cl.[6] ..... F42B 3/00

[52] U.S. Cl. ..... 102/311; 102/312; 102/313; 102/320; 175/4.55

[58] Field of Search ..... 102/312, 313, 320, 311; 175/4.55

[56] References Cited

U.S. PATENT DOCUMENTS

| | | | |
|---|---|---|---|
| 3,903,799 | 9/1975 | Walker | 102/23 |
| 4,146,429 | 3/1979 | Slagley | 176/38 |
| 4,273,050 | 6/1981 | Brown | 102/321 |
| 4,353,598 | 10/1982 | Ricketts | 102/312 X |
| 4,367,901 | 1/1983 | Cha | 102/312 X |
| 4,402,550 | 9/1983 | Ricketts | 102/312 X |
| 4,440,447 | 4/1984 | Ricketts et al. | 102/312 X |
| 4,545,622 | 10/1985 | Yang | 102/312 X |
| 4,976,199 | 12/1990 | Benkes et al. | 102/200 |
| 5,159,149 | 10/1992 | Marsden | 102/217 |

*Primary Examiner*—Peter A. Nelson
*Attorney, Agent, or Firm*—Diamond C. Ascani

[57] ABSTRACT

A formation is blasted with one or more arrays of elongated, chemical, explosive charges so as to produce relatively low levels of ground vibration. The orientation and velocity of propagation of explosion in each charge and the velocity of propagation of vibration in the formation are such that, at a selected outlying location, the onset of vibration from explosion of the first negligably small increment of the charge arrives a finite time before that from explosion of the last negligably small increment. The charges of each array are fired in accurately-timed sequence, with the times between initiations chosen so that, at the outlying location, the onset of vibration from explosion of the last small increment of each charge, except the last charge, arrives a negligably small increment of time before the onset of vibration from explosion of the first small increment of the succeeding charge. All arrays ape designed to give equal times between onsets of vibration from the first and last charge increments to explode. Arrays are initiated in accurately-timed succession such that, at the outlying location, the onsets of vibration from the first small increment of charge to detonate in each of the arrays arrive separately at time intervals approximately equal to zero to four complete periods of a major Fourier component of the vibration from a single array, plus one period divided by the number of arrays. Explosives having low rates of propagation are preferred.

18 Claims, 9 Drawing Sheets

METHOD OF REDUCING GROUND VIBRATION FROM DELAY BLASTING

BACKGROUND OF THE INVENTION

1. Field of the Invention

This invention relates to a method of arranging the charges of explosive in a multi-charge blast for breaking up or displacing a geological mass, and of timing successive detonations of the charges, by which the ground vibration produced by the blast at one or more chosen outlying locations is reduced, and by which the explosion energy available for increased fragmentation or displacement of the burden can thereby be increased.

2. Description of the Related Art

In the conventional practice of blasting in a geological formation, a pattern of boreholes is drilled into the formation, explosives and detonators are loaded into the boreholes, the resulting charges are then confined with stemming of aggregate, and the explosive charges are then detonated to break up and displace a portion of the nearby rock or soil. This blasting action is the result of high transient gas pressures applied to the borehole walls by the gaseous products of detonation. These pressures produce compression waves that propagate outward from the boreholes and are partially absorbed by the processes of fragmentation and displacement. But waves that escape from the vicinity of the pattern of boreholes in the form of ground vibration can damage outlying structures, interfere with outlying operations or annoy outlying residents. Furthermore, such ground vibration carries energy that was expensive to produce but was not used to do useful work, The use of time delays between initiations of the charges is an established method of increasing desired fragmentation and displacement, of decreasing undesired damage to a remaining rock face, and of decreasing ground vibration at locations distant from the blast. The charges used in conventional blasting have a typical length of 10 meters and a typical detonation velocity of 5000 m/sec, so that a typical charge is consumed by its detonation in only 2 milliseconds. Delay times used between charges, in order to allow time for sufficient movement of the rock between detonations, are typically an order of magnitude longer, Therefore the ground vibration typically produced at locations distant from such blasts is characterized by a long wavetrain of substantial amplitude which contains vibrational energy produced by the successive, short, well-separated in time, bursts of pressure exerted against the rock by the short, well-separated explosions. Some success has been obtained in reducing ground vibration and improving the blasting action from such blasts by calculating the power or amplitude spectrum from a digital recording of the vibration produced at an outlying location by a single small charge shot in the vicinity of the planned blast and then choosing time delays between charges that are equal to periods of vibration from the small charge that contributed relatively little energy to the spectrum and are not close to the natural periods of vibration of vulnerable structures near the outlying location. Time delays chosen in this way have no consistent or recognized relationship to the length or detonation velocity of a charge, to the velocity of propagation of the ground vibration, or to the difference in range from particular locations in the charges to the outlying location where ground vibration is to be reduced. Also, the time delays between charge initiations chosen in this way are typically much longer than the time required for detonation to consume a charge. Thousands of blasting patterns and time delay arrangements have been proposed in the past, of which those disclosed in U.S. Pat. Nos. 3,295,445, 3,903,799, and 4,770,097 may be cited. But in spite of the limited success obtained through the use of present practices, at many blasting operations a pressing need remains for further reductions in ground vibration or for making larger blasts with no appreciable increase in ground vibration, or for increasing the efficiency with which the energy of the explosive is used to do useful work in the form of increased fragmentation and/or throw.

Some of the prior art teaches the use of extremely high effective detonation velocities, achieved through the use of multiple points of initiation in the same charge, to obtain improved blasting action and/or reduced ground vibration. For example, U.S. Pat. No. 3,457,859 teaches that the use of multiple points of initiation in each charge results in improved fragmentation, and U.S. Pat. No. 4,382,410 teaches that the use of multiple points of simultaneous initiation in a charge surrounded by an air annulus results in both increased rock fragmentation and reduced ground vibration. In contrast, U.S. Pat. Nos. 5,071,496 and 5,099,763 teach the use of an explosive of unusually low detonation velocity together with a conventional arrangement of time delays to obtain increased throw of the burden and reduced ground vibration. Other examples of the use of explosives of very low detonation velocity are given in U.S. Pat. No. 4,864,933 which teaches the use of such explosives for stemming, in place of aggregate, and U.S. Pat. No. 4,864,933 which teaches their use for stimulating wells, but like the rest of the prior art these patents do not recognize any relationship between the velocity of detonation and the optimum time delay between detonations for reducing ground vibration. Blasting with black powder, which also has a very low velocity of propagation, is old in the art and it is still used for blasting dimensioned stone. But its use in general rock blasting became obsolete long before the development of blasting with accurate, short time delays. No disclosure is known of its use with accurate delays chosen to take advantage of its low velocity in order to reduce ground vibration.

SUMMARY OF THE INVENTION

This invention provides a method of blasting a geologic formation with chemical explosive charges so as to reduce the level of ground vibration at a selected outlying location and leave more energy available for fragmenting and displacing adjacent material than is the case for conventional methods of blasting, In particular it provides a method of blasting with a pattern of charges comprising one or more arrays of elongated charges enplaced in the formation. The method requires firstly that, for each charge in the pattern, the following relation holds:

$$(C/D)>(R/L)-(OIL)$$

where C is the velocity with which ground vibration propagates in the formation near the charges, D is the rate at which detonation propagates through the charge, R and Q are, respectively, the shortest distances through the formation to the outlying location from the location of the detonator and from the location of the terminal end of the charge where detonation ceases, and L is the distance from the location of the detonator to the terminal end of the charge. Within each array, the required time delay, $T_m$, between each initiation of explosion of a charge (designated charge m) and the immediately succeeding initiation of explosion of the next charge (designated charge m+1) is given by:

$$T_m=(L_m/D_m)+(Q_m/C)-(R_{m+1}/C)+>0 \text{ for } m=1,2,3, \ldots (n-1)$$

where $L_m$, $D_m$, and $Q_m$ are, respectively, the values of L, D, and Q for charge m, and $R_{m+1}$ is the value of R for charge (m+1), and the array contains n charges designated, respectively, 1,2,3, ... m, ... n. Further reduction in vibration at the same outlying location can be obtained by using a blasting pattern comprising N such arrays where N>1. In this case the arrays are required to be all of approximately the same in design, all adjacent to each other and approximately equally spaced, all with approximately the same orientation, all with the detonators of the first charge in each array lying on or close to the same straight line, and with all arrays having the same overall detonation time. Designating the individual arrays 1,2,3, ... k, ... N in order of their relative positions, the required time delays, $T_k$, between successive initiations of each pain of adjacent arrays k and (k+1) are given by:

$$T_k=(R_{1,k}/C)-(R_{1,k+1}/C)\pm[(N^{-1}+j)/f]>0 \text{ for } k=1,2,3, \ldots ,(N-1)$$

where $R_{1,k}$ and $R_{1,k+1}$ are, respectively, the values of $R_1$ for the detonator locations of the first charges (m=1) to be initiated in an array k and then in the adjacent array (k+1), N is the number of arrays in the blasting pattern, j is an integer chosen from the values −4,−3,−2,−1,0,+1,+2,+3,+4, with values closest to 0 being preferable, and f is the frequency of a peak in the Fourier amplitude or power spectrum of the ground vibration produced at the reference location by one array alone. The sign ± in the expression for $T_k$ is chosen to be consistently either + or −. As indicated in the above relationships, geometries, values of D or j, or choice of sign that, in combination, result in non-positive values of $T_m$ or $T_k$ are unsuitable.

BRIEF DESCRIPTION OF THE DRAWINGS

For ease of understanding, reference will now be made to the drawings which illustrate, by way of example only, the principles underlying the present invention and various embodiments of the invention.

DETAILED DESCRIPTION

Figure 1:
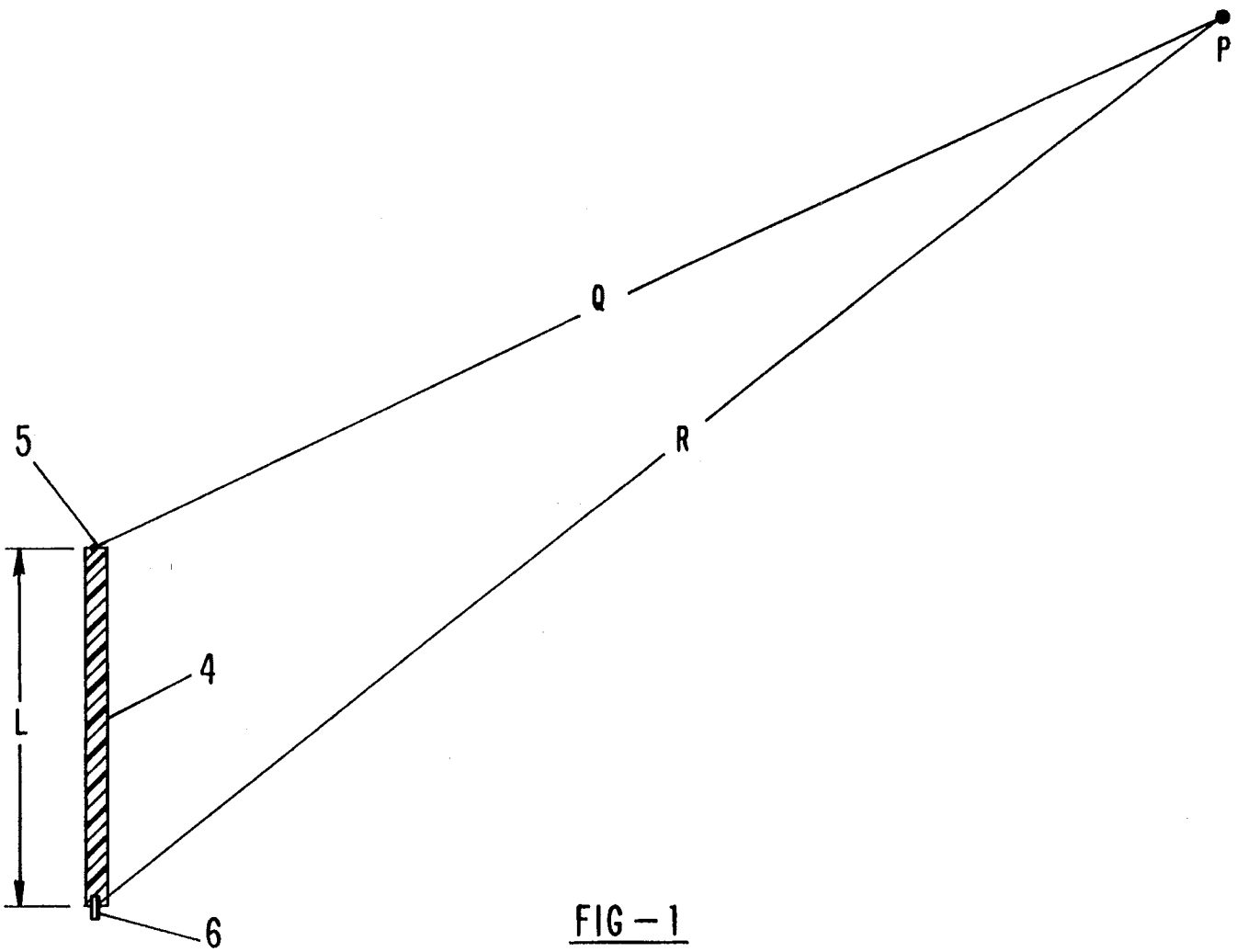
FIG. 1 is a schematic illustration of an elongated charge of explosive imbedded in a geological formation, and of an outlying location in contact with the formation where ground vibration produced by detonation of the explosive is to be reduced.

The term "detonator" as used herein denotes a blasting cap plus any cap sensitive booster charge or primer used with the cap to ensure initiation of the main charge, The term "detonation" as used herein denotes a process by which an explosive charge is converted to gaseous products at high pressure in a zone of chemical reaction that propagates through the charge at a rate that may be supersonic or subsonic but is at least 200 meters per second. The term "detonation" is therefore intended to include rapid deflagrations in which chemical reaction is initiated by thermal conduction and convection as well as conventional detonations in which chemical reaction is initiated by a supersonic shock front supported by chemical reaction. In particular, the term "detonation" as used herein includes the explosion of compositions such as black powder; those disclosed in U.S. Pat. No. 4,764,231 which have velocities as low as 704 meters per second; those disclosed in U.S. Pat. No. 4,864,933 which, as a result of phlegmatizing a conventional blasting agent with water, have average velocities of 1,100 meters per second; those disclosed in U.S. Pat. Nos. 5,071,496 and 5,099,763 which, as a result of phlegmatizing a conventional blasting agent with water injected circumferentially into a hose through which the explosive is pumped and then using a relatively weak primer as part of the detonator assembly, have velocities of 200 to 1000 meters per second; and conventional blasting agents, some of which have velocities greater than 6000 meters per second.

When blasting in accordance with the present invention, a pattern of boreholes having precisely known collar positions, orientations, and depths is first drilled into a geological formation. The pattern will usually, but not necessarily, comprise one or more straight lines of holes. Explosives and detonators capable of being initiated at pre-determined and precisely-known times are then loaded into the holes so as to form a set of charges having precisely-known lengths, locations, and detonator locations. The detonators are preferably placed at one end of each charge, but alternatively may be placed at their midpoints. Individual boreholes may be loaded with only one such charge or may contain several of them separated by sections of borehole filled with inert aggregate. The boreholes are then usually obturated with stemming in the form of a volume of aggregate such as crushed stone. In an alternative arrangement designed to obtain better fragmentation around the top of the borehole when the detonation velocity less than 1200 meters per second, the stemming is omitted, the column of explosive is brought up into all or part of the borehole usually reserved for stemming, and the charge is initiated at its bottom or midpoint. This arrangement differs from that disclosed in U.S. Pat. No. 4,864,933 in that the entire charge rather than just a top section consists of explosive having a very low velocity.

In order to calculate the time intervals to be used between successive initiations of the detonators, the pattern of charges is divided into one or more arrays of charges, where an array of charges comprises a set of at least 2, and preferably at least 6, adjacent charges. Thus, all the charges in a line of holes, or the decked charges at one level in a line of holes, or multiple decked charges in one hole may be treated as an array.

Ground vibration at an outlying location resulting from detonation of an array is minimized by setting the time delay between each pair of successive initiations in the array so as to make ground vibration from the termination of detonation in a charge and from the initiation of detonation in the succeeding charge arrive simultaneously at the outlying location, as will be explained. And when the pattern of charges contains more than one array, the arrangement of the arrays, and the time delays between successive initiations of the first charge in each array, are chosen so as to further reduce the vibration, as will be explained.

The ground vibration from a multi-charge blast, measured at an outlying location such as next to a vulnerable building, is the superposition of the vibrations from the explosions of the individual charges, these superpositions : being delayed relative to one another by the time delays between initiations of the individual charges plus any differences in the travel times of the vibrations caused by any differences in the distances to the outlying location from the individual charges. In order to explain the basis for the time delays to be used between initiations of charges in an array, the character of the vibration from a single charge will first be explained by reference to FIGS. 1, 2, 2A, and 2B.

FIG. 1 is a schematic diagram of an elongated charge 4 of uniform cross section and detonation velocity D emplaced in a borehole drilled into a geological formation. It is fitted with a detonator 5 located at a distance L from the terminal end of the charge 6 where detonation ceases. The charge detonates upon firing the detonator, whereupon compressional waves leave its vicinity at a velocity C, which is the velocity of sound in the formation in the vicinity of the charge. The outlying location P at which ground vibration is to be reduced, lies at a distance R from the location of the detonator 5 and at a distance Q from the terminal end of the charge 6, where R and 0 are taken to be the lengths of the shortest paths that sound can take to P through the geological formation. These shortest paths are usually taken to be the lengths of single straight lines, but not if a single straight line would be partly in air. For example, if the terminal end of the charge were behind the top of a quarry face, and P were in front of the quarry face, then 0 would be the length of a straight line from the terminal end of the charge down to the toe of the face plus the length of another straight line from there to P. Upon firing the detonator at a time $t=t_O$, a chemical reaction front characterized by the generation of gas at high pressure is suddenly formed and travels through the charge, arriving at its end and extinguishing when time $t=t_O+(L/D)$. Referring now FIG. 2, which is a schematic plot of thrust on the borehole wall versus time denerated by a charge, beginning when time $t=t_O$ and as indicated by segment 7 of the plot, the thrust begins to increase with explosive rapidity. Then as indicated by segment 8, the thrust increases much more slowly as expansion of the borehole partially relieves the gas pressure. As indicated by segment 9, given a sufficiently long detonation time, the thrust will then reach a relatively constant value as the formation of gas by the detonation is balanced by increases in the volume of the gas-filled cavity as a result of massive outward movement of the surrounding material. Then, as indicated by segment 10, detonation finally reaches the end of the charge at time $t=t_O+(L/D)$, whereupon gas production suddenly stops and the thrust decreases very rapidly. Finally, as indicated by segment 11, the thrust decays to zero as the gas-filled cavity continues to expand.

The situations considered herein are limited to those in which the detonation velocity of the explosive, the velocity of sound in the geological formation near the blast, and the distances from the the initiated and terminal ends of a charge are such that vibration from firing the detonator arrives at an outlying location where vibration is to be reduced before the arrival of vibration from the detonation of the terminal end of the charge.

In such a case, steady thrust against the borehole produces no ground vibration at a distant point just as, for example, the steady thrust of a heavy object resting on the ground produces no vibration. And a slowly changing thrust produces little vibration. But if a heavy object is suddenly placed on the ground or a high thrust is suddenly exerted against a borehole wall a burst of compression and shear waves will propagate outward from the region where the force was applied. And if the object is suddenly lifted or the thrust against the borehole suddenly decays, thereby perturbing the steady state, another burst of vibration will propagate outward from the same place, with particle motion that, at large distances, is essentially equal in magnitude to that of the previous burst, but in the opposite direction. The rate of change of thrust, i.e. its derivative with respect to time, drives the ground vibration.

Figure 2:
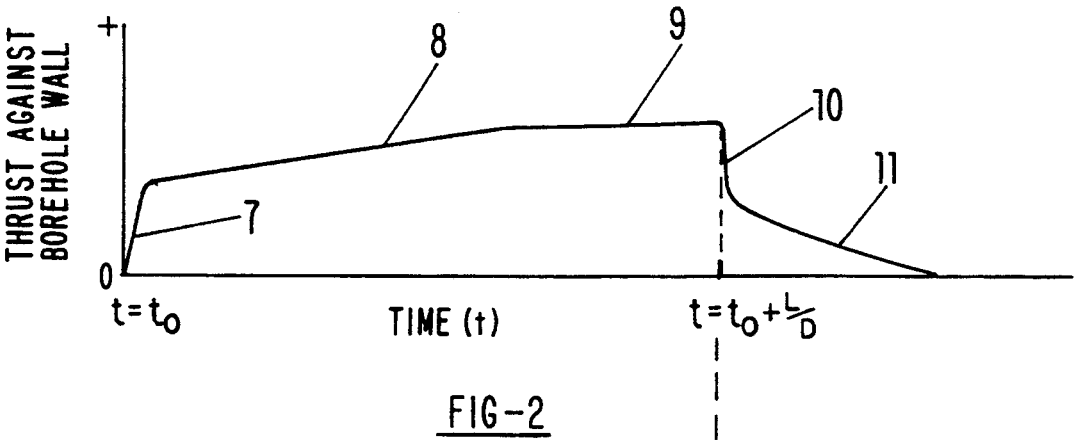
FIG. 2 is a schematic plot of the total thrust, as a function of time, applied to the geological formation by the high-pressure gaseous products produced by detonation of the change.
Figure 2A:
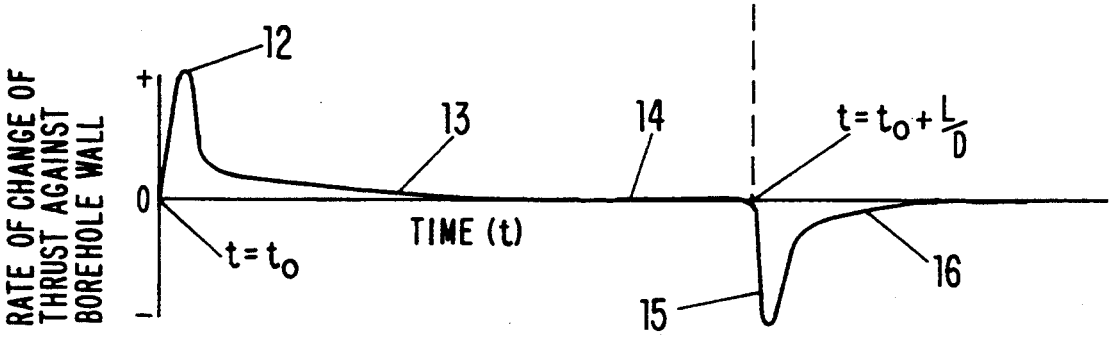
FIG. 2A is a schematic plot of the Pate of change of thrust on the borehole wall produced by detonation of the change.
Figure 2B:
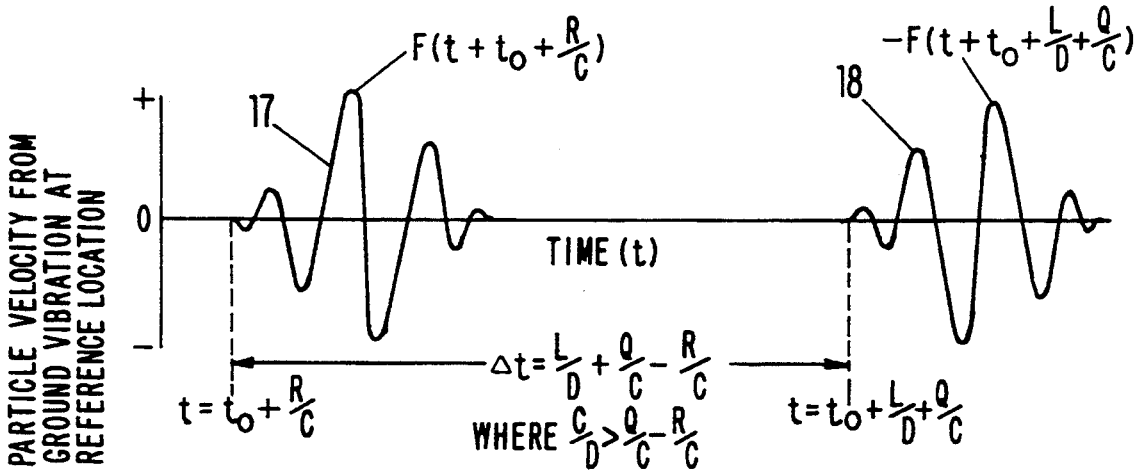
FIG. 2B is a schematic plot of the particle velocity of the ground vibration at the reference location, as a function of time, produced by changes in the thrust against the borehole wall resulting from detonation of a single charge.

FIG. 2A is a schematic plot of the derivative of the thrust that is plotted in FIG. 2. It is zero prior to time $t=t_O$ and then upon firing of the detonator it rises to a positive peak as illustrated in segment 12 of the plot. As detonation steadily consumes the charge, it then subsides to low levels as indicated in segments 13 and 14. Upon cessation of detonation at time $t=t_O+(L/D)$ it rapidly falls to a negative peak, as indicated schematically in segment 15. Finally, as the gas pressure returns to a steady value of zero, the derivative of the thrust returns to zero as illustrated in segment 16. Although the form of the final negative segment of the derivative tends to be equal in magnitude and opposite in sign compared to the initial segment, the forms and magnitudes can be expected to differ in detail. The positive and negative segments in the time derivative of thrust will each produce a burst of ground vibration. When the velocity of detonation D exceeds the velocity C with which compressional waves propagate in the nearby formation, i.e., when $(C/D)<1$, outlying locations may exist at which the onsets of these two bursts of vibration will arrive simultaneously or with their arrival times reversed. This invention does not apply to such situations, but only to situations where the onset of vibration associated with firing the detonator of a charge arrives at an outlying location P before arrival of the onset of vibration associated with termination of detonation of the charge. This requirement is that $t_O+(R/C)<t_O+(L/D)+(Q/C)$ and therefore that, for each charge in the pattern, $(C/D)>(R/L)-(Q/L)$. This requirement, which is designated "Requirement 1" in the examples, is, of course, most strongly met when D is substantially smaller than C, and therefore explosives having a relatively low detonation velocity are preferred, When $(C/D)>1$ this requirement is met at all outlying locations for all orientations of a charge, and for all values of C and D this requirement is satisfied at all sufficiently distant locations in horizontal directions from a vertical charge, Differences in the arrival time of vibration at the outlying location from various locations within the charge pattern are determined not only by differences in the times of emission of the vibration but also by differences in path length and the propagation velocity of the vibration while still close to the pattern. This velocity is the compressional velocity, i.e., the sound velocity in the formation close to the array, even though some of the compressional wave energy is eventually transformed into shear waves, Love waves, and Rayleigh waves which have other velocities, Therefore the sound velocity, which is the velocity of low-amplitude compressional waves, is used for. C, Ray path segments close to the charges where the velocity may be a supersonic shock velocity tend to be equal in length and therefore do not affect differences in arrival time at an outlying location, The two bursts of ground vibration from detonation of a charge, as detected at a location meeting the above requirements, are plotted schematically in FIG. 2B, As indicated, the times of onset of the two bursts of ground vibration are separated by a time interval $t=(L/D)+(Q/C)-(R/C)$. Because the first burst is caused by the sudden application of thrust and the second burst is caused by the sudden removal of that thrust, and because the forms of the resulting wavetrains are determined more by the character of their essentially identical paths through the geological formation than by fine details of their original forms, the functional form of the first burst of vibration may be written as $F[t+t_O+(R/C)]$ and that of the second burst, delayed in arrival time by a time interval, $\Delta t$, equal to $(L/D)+(Q/C)-(R/C)$ and of approximately equal but opposite amplitude, may be written as $-F[t+t_O+(L/D)+(Q/C)]$, Owing to the multiple paths and multiple wave types by which the waves propagate through the geological formation to an outlying location, the duration of each burst arriving at the reference location will generally be much longer than the time delay between onsets of the bursts, Therefore the tail of the first burst will generally be much longer than the time delay between the onsets of the bursts, and therefore the tail of the first burst will be superposed on the second burst. The resulting form of the vibration will therefore not appear to be made up of two simpler and superposed parts having equal but opposite amplitudes, even though it is. This superposition does not affect the functioning of the present invention, but for clarity of explanation the figures show bursts of vibration that are so short that they do not overlap.

Figure 3:
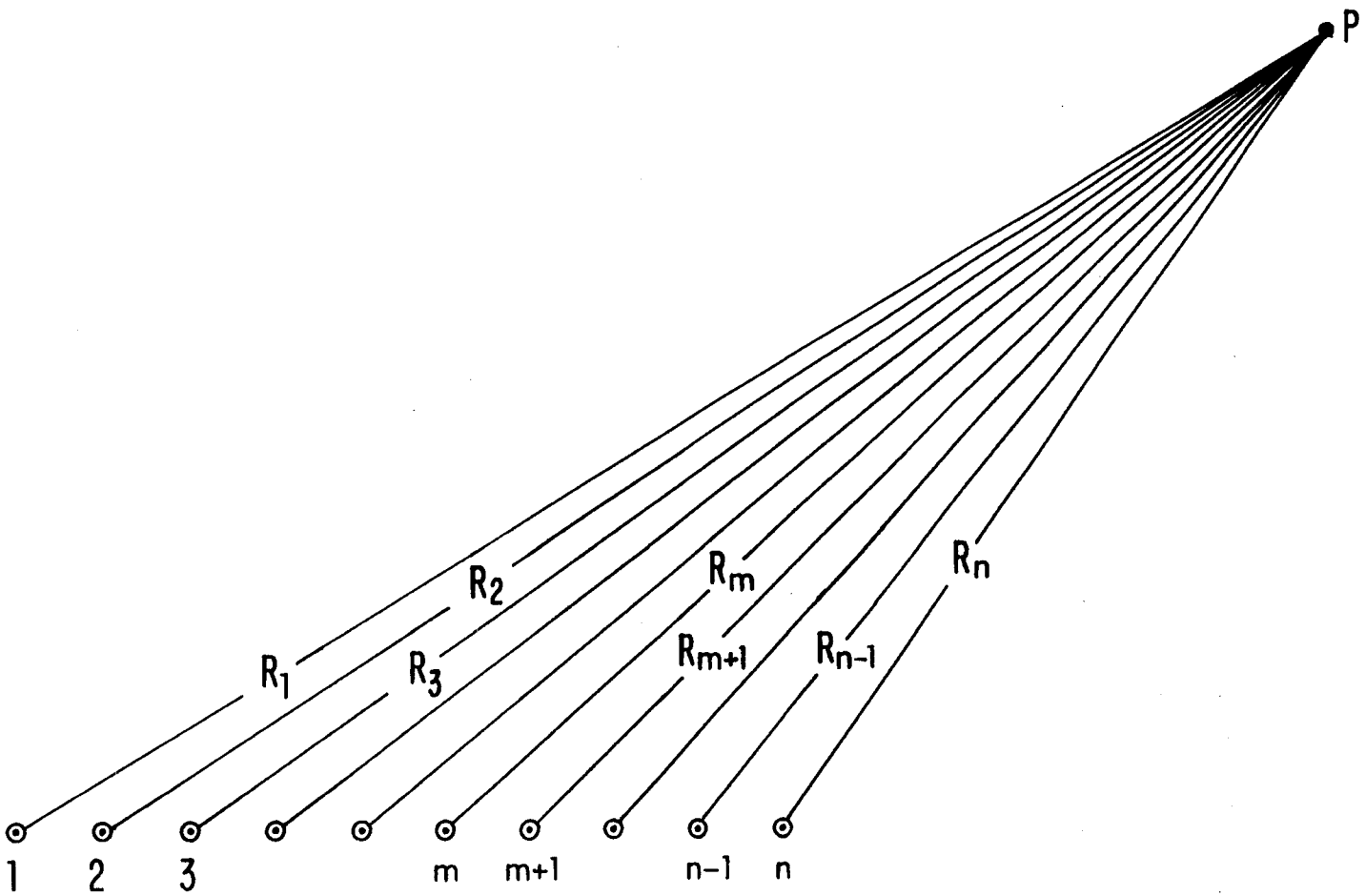
FIG. 3 is a schematic plan view of the detonators of an array of columnar changes initiated in accordance with the teachings of this invention so as to reduce vibration at an outlying location.
Figure 3A:
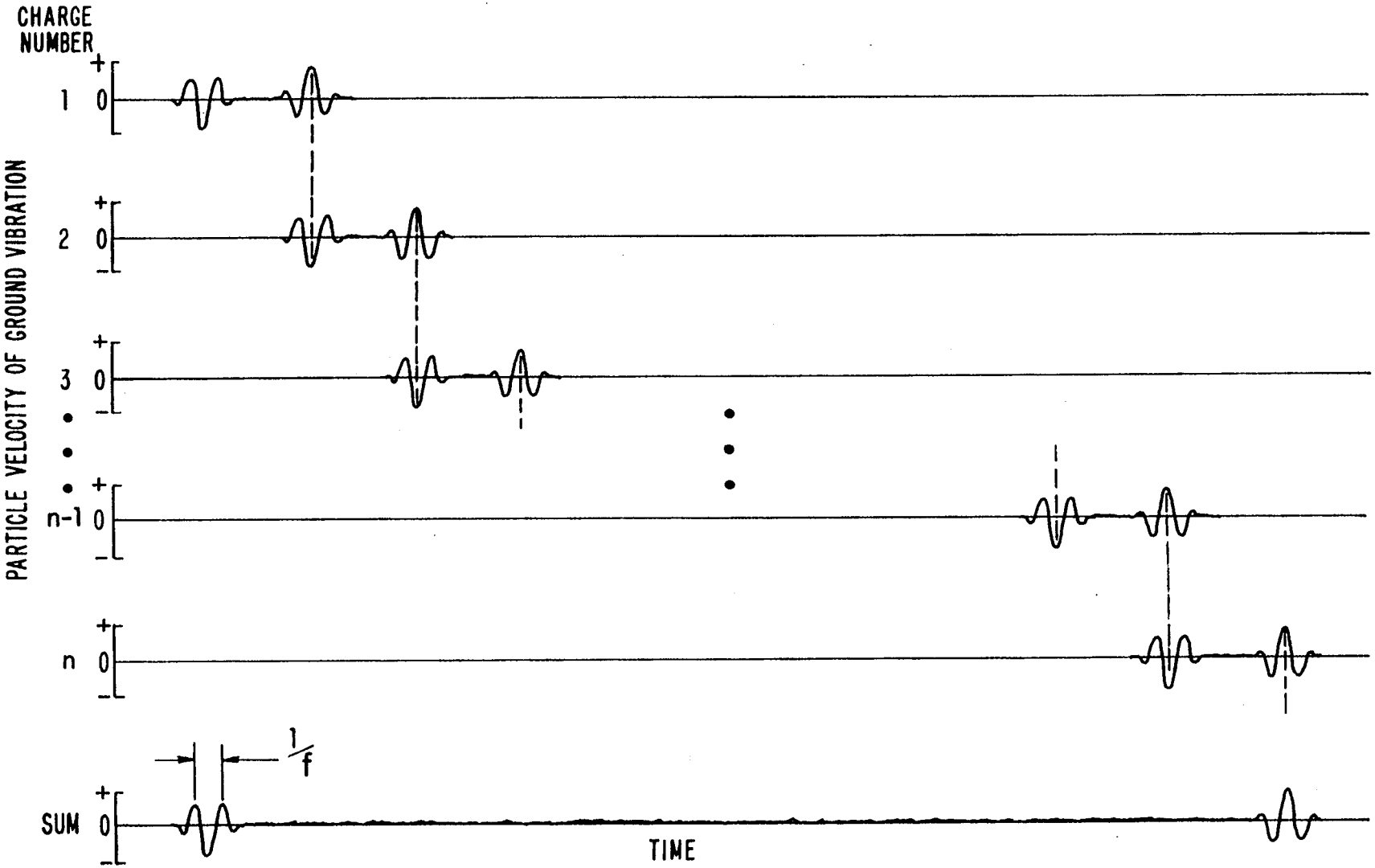
FIG. 3A is a schematic illustration of the ground vibration arriving at the outlying location from detonations of the separate charges of the array shown in FIG. 3, together with the resulting ground vibration which is the sum of the vibrations from the individual charges.

The ground vibration from the successive detonations of an array of elongated charges, measured at an outlying location such as at a vulnerable building, is the superposition of the vibrations from the succession of individual detonations, FIG. 3 illustrates in plan view the positions of the detonators in such an array containing n charges. Vibration will be minimized at an outlying location P shown in the figure when the time delay between successive firings of the detonators is such that the onset of vibration from termination of detonation of a charge occurs at P at the same time as the onset of vibration from firing the detonator of the succeeding charge. This situation is illustrated in FIG. 3A, which illustrates the two bursts of vibration from each charge, with the arrival times delayed so as to minimize the vibration resulting from their sum. Under these conditions, every burst of vibration except the first and last will be superposed on a burst from the preceeding or succeeding charge so that they cancel each other, each member of a superposed pair having, at equal times, equal but opposite amplitudes from the other. The requirement that this cancellation occur is:

$$T_m=(L_m/D_m)+(Q_m/C)-(R_{m+1}/C)>0 \text{ for } m=1,2,3,\ldots(n-1)$$

where $T_m$ is the required time delay between successive initiations of charges in the array, $L_m$, $D_m$, and $Q_m$ are, respectively the values of L, D, and Q for any charge m except the last charge in the array to be detonated and $R_{m+1}$ is R for the next charge in the array to be detonated after charge m. The indicated requirement that $T_m > O$ implies the following required condition:

$$(C/D_m) > (R_{m+1}/L_m) - (Q_m/L_m)$$

This requirement, which is designated "Requirement 2" in the examples, is, like Requirement 1, most easily met with explosives having a very low detonation velocity. In the special case where $R_m$ is sufficiently large compared to the dimensions of the array and is approximately normal to a plane containing the elongated charges of an array, then $Q_m = R_{m+1}$ so that $T_m = (L_m/D_m)$ for all time delays between charges in the array. That is, the desired time delay between initiations of two changes in the array is simply equal to the time required for the first charge to detonate. For the same reason, if the charges in an array are tilted so that the terminal end of each change lies directly above or below the detonator of the succeeding change to be detonated, and if Requirement 1 is satisfied for each tilted charge, then for any outlying location in a horizontal direction at which vibration is to be minimized, and whether or not the charges are all lying in the same plane, $T_m = (L_m/D_m)$ for all the time delays in the array. In such an arrangement it is possible to have the first and last charges vertical but shorter than the others.

Figure 4:
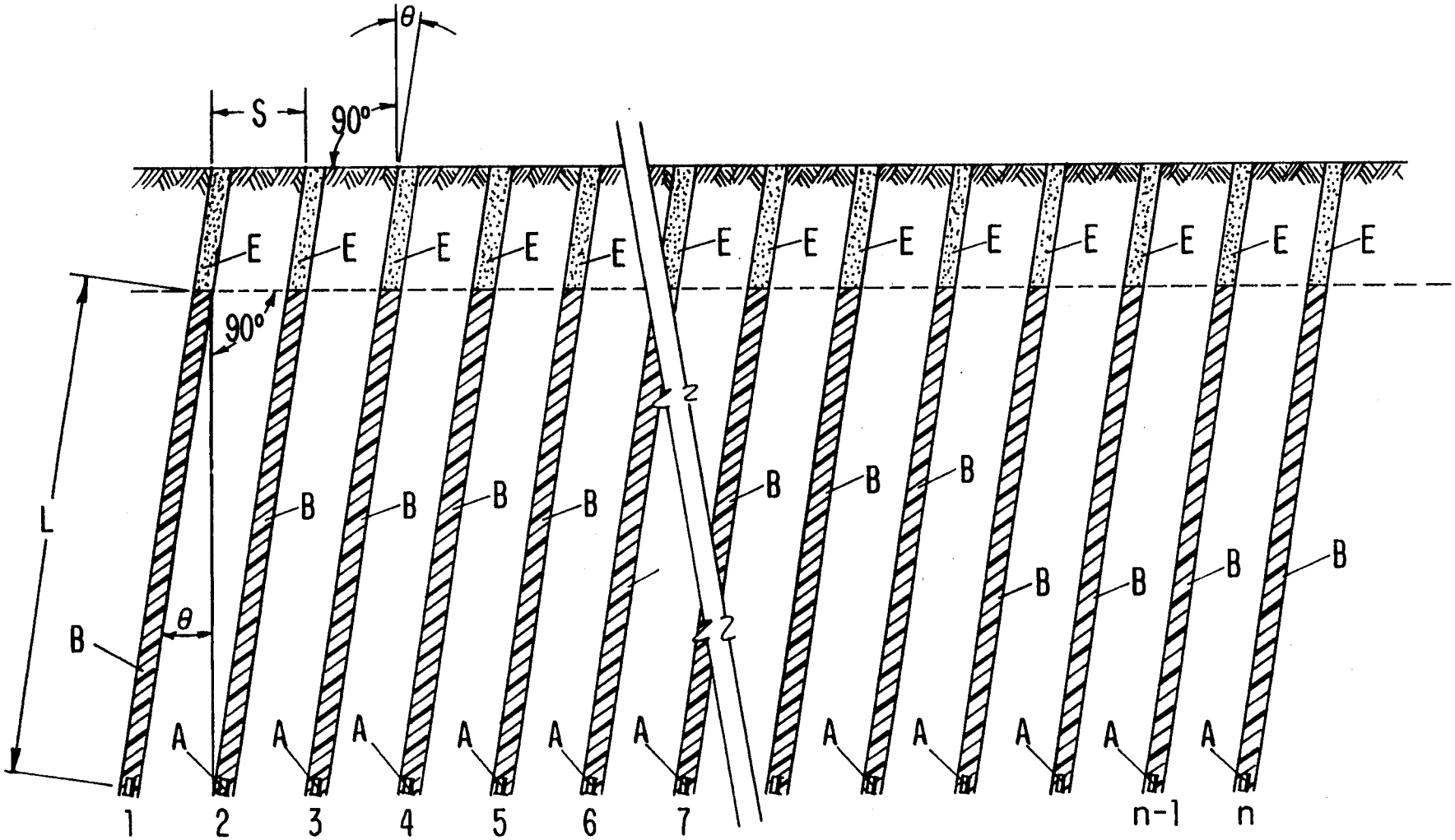
FIG. 4 is a schematic view in elevation of an array of charges arranged and initiated in accordance with the teachings of this invention, in the special case where the charges are tilted so as to minimize ground vibration at all sufficiently distant locations in horizontal directions from the array.

FIG. 4 is a view in elevation of an array of tilted charges. It shows n charges of length L, having horizontal spacings S between boreholes, and provided with stemming E, with all charges tilted in the same direction by an angle $\phi$ from the vertical in the direction of the line of boreholes, where:

$$\phi = \text{arc sin}(S/L)$$

Thereby, with the detonators A placed at the bottom of each charge B, the terminal end of each charge is directly above the detonator of the next charge to be fired so that, for any pair of charges m and (m+1) to be fired in succession and for all outlying locations toward which the shortest distances radiate from the array in horizontal directions, $Q_m = R_{m+1}$. Therefore Requirement 2 is satisfied for each charge pair and ground vibration will be minimized at all such outlying locations when the time delay used between successive initiations of the detonators in the array is given by $T_m = (L_m/D_m)$.

Figure 5:
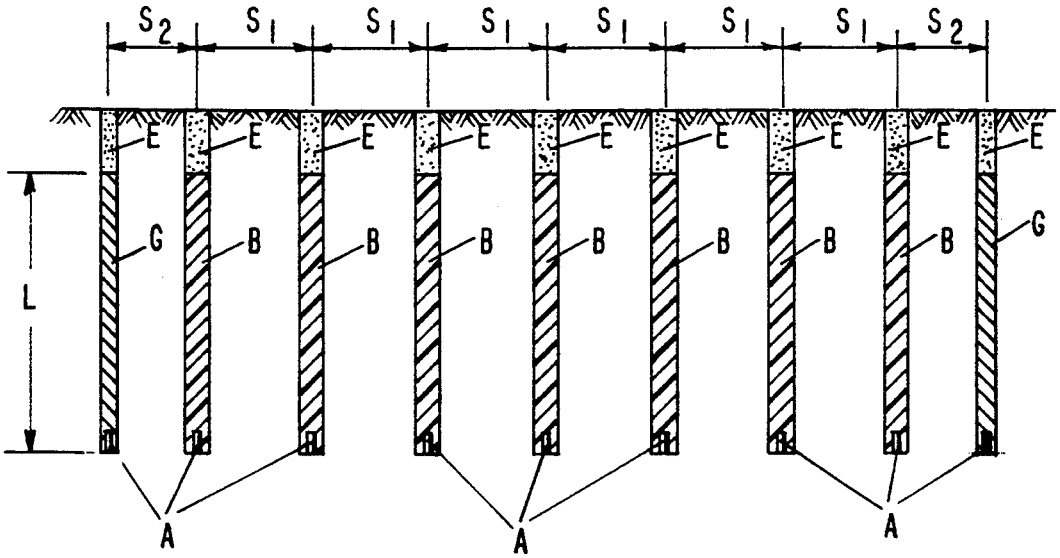
FIG. 5 is a schematic view in elevation of an array of charges arranged and initiated in accordance with the teachings of this invention, in the special case where the first and last charges of the array have a reduced rate of energy release during detonation relative to the other charges of the array, so as to reduce the bursts of ground vibration caused by starting and ending the detonation of the array.

As previously described, when an array of charges is emplaced and detonated in accordance with this invention, ground vibration which is minimized at a chosen outlying location nevertheless still occurs there, and is produced mainly by the sudden initial starting, and again by the sudden final stopping, of the detonation of the array. Therefore, further reduction in these initial and final bursts of vibration can be obtained by starting and stopping the explosion of an array more gradually. This can be done by reducing the explosive power of the first and last charges or the first few and last few charges detonated in the array. When more than one charge of reduced power is used at the beginning and end of an array, it is preferred to graduate their power levels with each of the first few charges having more power than that of the previously detonated charge and each of the last few charges having less power than that of the previously detonated charge. Some or all of these charges of graded power level may be placed end to end in the same borehole, with no space or delay detonators between them, provided that their individual detonation velocities are not appreciably altered by such an arrangement, which relies on the propagation of detonation between charges whose power levels differ. In order to retain satisfactory blasting action, the charges of reduced power may be put on reduced spacings in an array. Such an arrangement is shown in FIG. 5, which is a schematic view in elevation of an array of 9 charges to be detonated in sequence from one end to the other, where E, A, and L have the previous meanings and the first and last charges G to be detonated are reduced in power compared to the other charges B. In this case they are reduced in power by being loaded into boreholes of smaller diameter than the rest of the boreholes and are spaced at a reduced distance $S_2$ from the rest of the boreholes, which are on larger spacings $S_1$. The explosive power is taken to be $(\pi/4)d^2De$ calories per second where D is the detonation velocity in meters per second, e is the absolute amount of energy available in each unit volume of explosive in calories per cubic centimeter, and d is the diameter of the charge in millimeters. Clearly, the explosive power may be reduced by reducing any of these three quantities or any combination of them. They are not independent variables because a reduction in d or e will usually result in a reduction in D. When D is reduced for a particular charge, Requirements 1 and 2 will still be met if they were met at the larger value of D. But in general L for these charges having reduced D must be decreased to leave their value of $(L_m/D_m)$ unchanged if $T_m$ is to remain unchanged for the time delay of the next initiation. Or if $L_m$ remains unchanged, then $T_m$ for the next initiation needs to be increased due to the increased value of $(L_m/D_m)$.

Figure 5A:
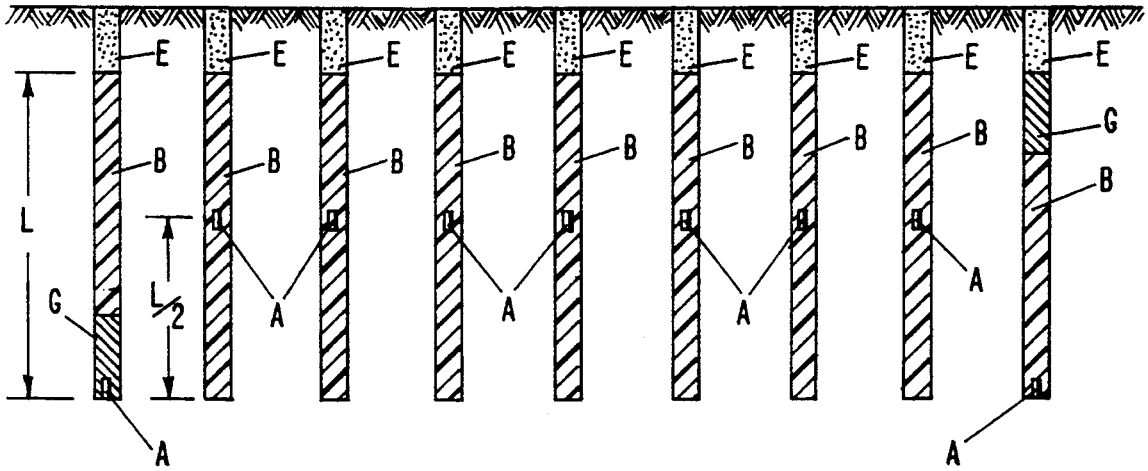
FIG. 5A is a schematic view in elevation of an array of charges arranged and initiated in accordance with the teachings of this invention, in the special case where the charges in the center of the array are initiated at their midpoints rather than at their ends and the first and last charges of the array are initiated at one end so as to release energy at half the rate of the other charges.

The method of the invention also can be practiced with charges that are initiated at their midpoints rather than at their ends. When doing so, the value of L to be used in calculating the delay times is half the total charge length because in this case the detonations travel a length of L/2 before reaching the terminal ends. For such charges, Requirement 1 must be satisfied separately for both halves of the charge, which under some circumstances may have different values of Q. When using charges initiated at their midpoints, lower levels of vibration can be expected if the beginning one or two charges and the ending one or two charges are initiated at one end, and optionally are of reduced power in accordance with the methods discussed above. Such an arrangement is shown in FIG. 5A, which is a schematic view in elevation of an array of 9 charges to be detonated in sequence from one end to the other, where E, A, S, L, B, and G have the previous meanings, G indicating in this case lengths of a full-diameter borehole loaded with first and last charges of lower power than the others, where detonators for the charges in the 7 center boreholes are placed at the midpoints of the charges and detonators for the charges in the first and last boreholes are placed in the bottom of the borehole.

Figure 6:
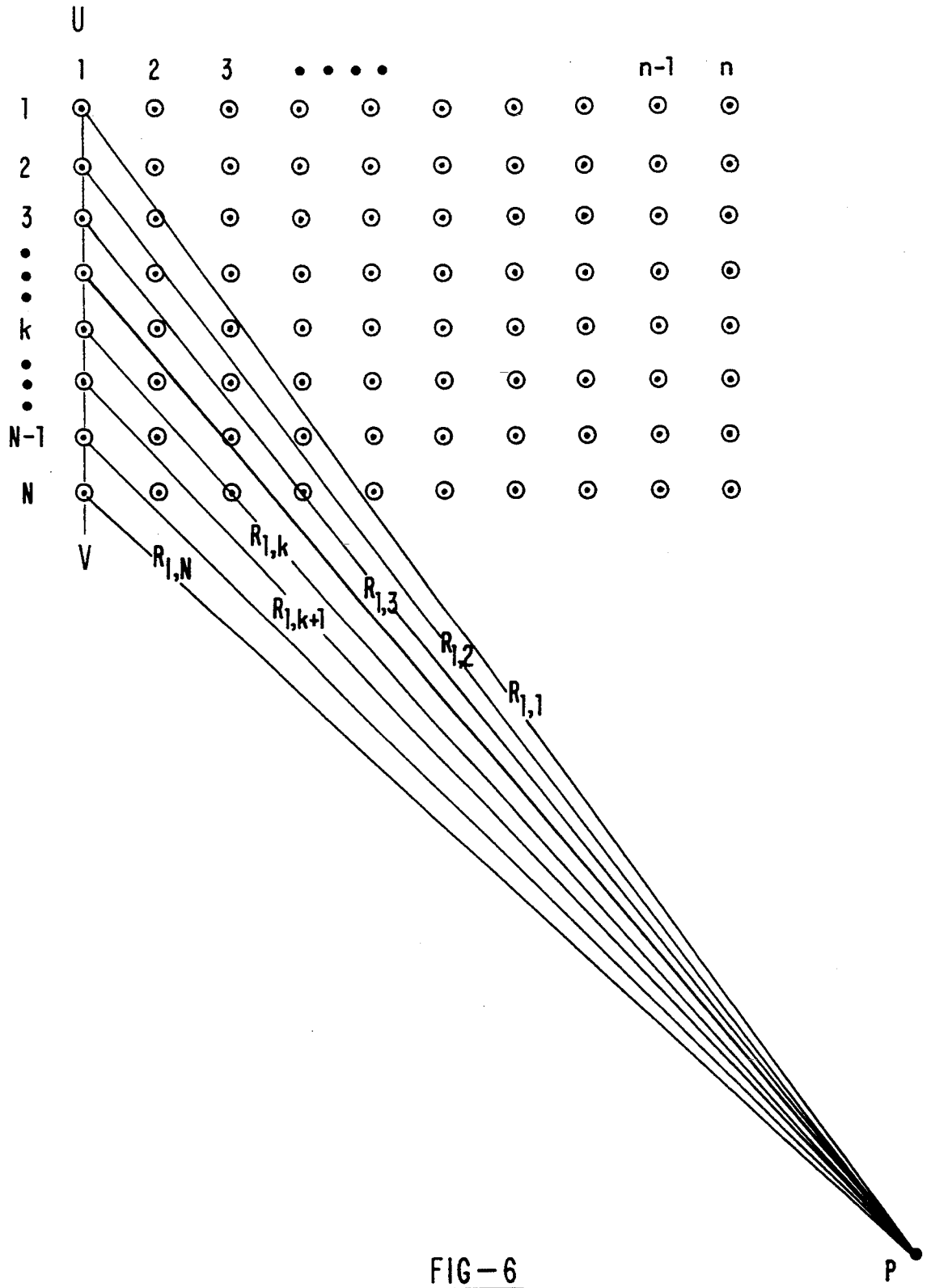
FIG. 6 is a schematic plan view of the detonators of a multiplicity of essentially identical arrays, each laid out and timed in accordance with the teachings of this invention, where the arrays have approximately the same orientation, are approximately equally spaced, have the detonators of the first charge in each array all lying on or close to the same straight line, and where the time delays between successive initiations of the arrays are timed to cancel ground vibration at and near a chosen frequency in the vibration arriving at an outlying location.

Further reductions in ground vibration at the same outlying location can be obtained by using a pattern of charges comprising N arrays, where $N > 1$; and where all of the arrays have essentially the same design; and where they have approximately equal orientation; and where all of them are adjacent to and approximately equally spaced from each other; and where those detonators, each of which is the first one to be fired in its array, all lie on or close to the same straight line; and where the time delays between charges in each array are in accordance with this invention; and where the times required for each array to detonate from first charge to last charge are approximately equal to each other; and where those detonators, each of which is the first one to be fired in its array, are initiated in the order in which they are located along the straight line, with time delays between their firings which will now be explained. These time delays can be chosen so as to largely cancel the beginning and ending bursts of vibration from each array which are illustrated schematically at the bottom of FIG. 3A. FIG. 6 is a schematic plan view of the layout of the detonator positions for such a blast in which there are N arrays of n charges each. P is an outlying location where vibration is to be reduced and $R_{1,1}$, $R_{1,2}$, $R_{1,3}$, ... $R_{1,k}$, ... $R_{1,N}$ are the distances to P from the N detonators, each of which is to be fired first in each of the N arrays. These detonators are to be fired in the same order in which they lie on or near to the straight line UV, with time delays between the initiation of any array k and initiation of the next array k+1 equal to $T_k$ where:

$$T_k=(R_{1,k}/C)-(R_{1,k+1}/C)\pm[(N^{-1}+j)/f]>0 \text{ for } k=1,2,3,\ldots,(N-1)$$

Where $R_{1,k}$ and $R_{1,k+1}$ are, respectively, the values of R for the detonator locations of the first charges (m=1) to be initiated in an array k and then in the adjacent array (k+1); j is chosen from the values −4, −3, −2, −1, 0, +1, +2, +3, +4 with values closest to 0 being preferable; and f is the frequency of a peak in the Fourier amplitude or power spectrum of the ground vibration generated at the outlying location by one array. Alternatively, f is the instantaneous frequency of one of the three orthogonal components of the ground vibration or of their vector sum at a time at which the component or the vector sum reaches a peak value. The sign ± in the expression for $T_k$ is chosen to be consistently either + or −. As indicated in the above relationship, geometries, values of D or j, or choice of sign that, in combination, result in non-positive values of $T_m$ or $T_k$ are unsuitable. Preferably j is chosen to be 0 or alternatively the integer having the smallest absolute value that will give calculated delay times $T_k$ most suitable for the blasting action desired. Although f is chosen to be equal to a frequency at which there is a peak in the Fourier amplitude or power spectrum of the of the ground vibration, or is the instantaneous frequency at the time of a peak in a component of the vibration or in the vector sum, preferably it is also a frequency less than 40 Hz or is a frequency close to that of an easily excited mode of vibration of the most vulnerable structure at the outlying location where vibration is to be reduced. The value of f can sometimes be estimated from inspection of the portion of the waveform having the highest amplitude, where the estimated value is the reciprocal of the period if that portion of the waveform has a simple, approximately sinusoidal, form. Such high amplitude portions will usually, but not always, occur near the beginning and end of the wavetrain. In any case, f can be obtained most accurately from the Fourier amplitude or power spectra of the longitudinal, vertical, or transverse components of the vibration or from calculation of instantaneous frequency at the time of occurrence of a major peak in vibration amplitude. Fourier amplitude and power spectra are, respectively, plots, as a function of frequency, of the contribution of waves of each frequency to the amplitude or energy of the resulting vibration.. Means of calculating them through the use of the Fourier transform are given in detail in texts on applied mathematics and signal processing. The vibration can be detected with a geophone located at the outlying location and can be recorded in digital form by a seismograph. A modern seismograph can then display separately the waveforms of the longitudinal, transverse, and vertical components of the vibration and of their vector sum, and can also calculate and display plots of the Fourier amplitude or power spectrum of each of the three components. The instantaneous frequency is the rate of rotation in the complex plane, in units of Herz, of the vector whose real part is the particle velocity of the ground vibration. Means of calculating the instantaneous frequency, through use of the Hilbert transform, are given in detail in texts on signal processing. The instantaneous frequency associated with a peak in the vector sum is $(f_V^2+f_T^2+f_R^2)^{\frac{1}{2}}$ where $f_V$, $f_T$, and $f_R$ are, respectively, the instantaneous frequencies for the vertical, transverse, and radial components of the vibration at the time of occurrence of the peak. In most cases, a value of f from a Fourier spectrum will be the preferred value to use, but when a single unusually high peak in the ground vibration is to be reduced, better results may be obtained through use of a value of f that is the instantaneous frequency at that peak.

The waveforms of the three components of vibration to be expected from an array, their vector sum, their spectra, and their instantaneous frequencies as a function of time, can also be calculated from the vibration wavetrain generated by a small test charge detonated in the geological formation in the vicinity of the planned blast and recorded at an outlying location where vibration is to be minimized. This vibration wavetrain will have the same form and amplitude as that is to be expected from a small increment of one of the elongated charges in an array of charges if its amplitude is scaled, for example, in proportion to $(M_i/M_c)^{0.785}$, where $M_i$ is the mass of the charge increment and $M_c$ is the mass of the small test charge. This scaling is in accordance with well-known experimental results from separate test charges of various masses. The entire array can then be viewed as composed of charge increments detonating in succession, where each increment generates an incremental wavetrain like the one whose vibration has been recorded and scaled, delayed in time of arrival by the increment of time required for detonation to consume the previously detonated increment. Therefore the expected vibration from the whole array with time delays in accordance with the invention can be obtained by adding together these calculated incremental vibrations as though produced by a single charge equal in length to the sum of the lengths of the charges in the array. The resulting waveforms for the three components of the vibration can be expected to be similar in form to the one illustrated schematically at the bottom of FIG. 3A. The calculated spectra of these waveforms will have one or more peaks, and values of f can be estimated from them as described above.

Figure 6A:
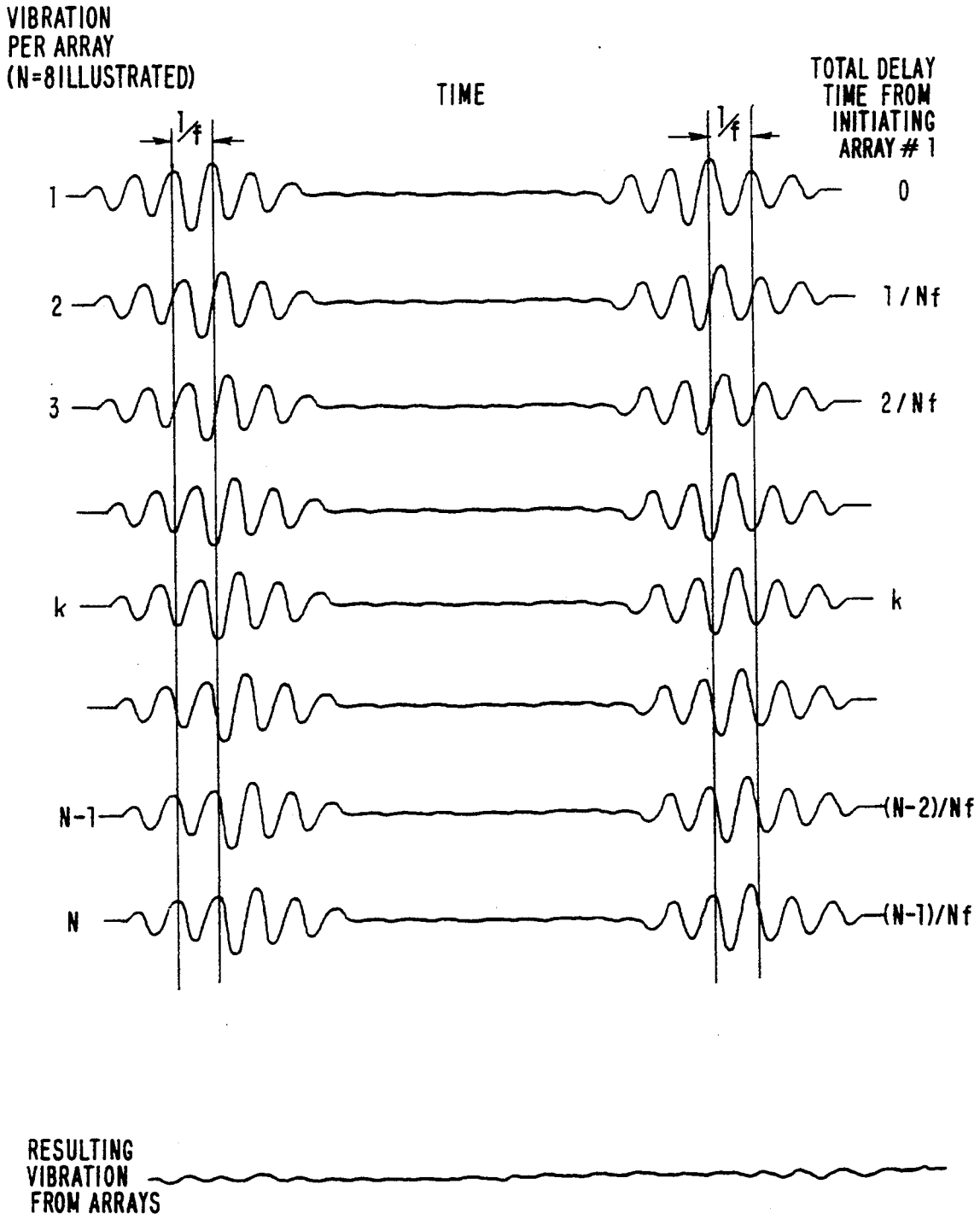
FIG. 6A is a schematic illustration of the ground vibration arriving at the outlying location from the time-delayed detonations of the separate arrays illustrated in FIG. 6, these vibrations being mainly due to starting and ending the detonation of each array, and the resulting very much reduced vibration, which is the sum of the vibrations from the separate arrays.

The vibration produced by the detonation of a pattern of N arrays according to the present invention is illustrated schematically in FIG. 8A for the blasting pattern of FIG. 6. The wavetrains arriving at the outlying location from each of the arrays in the pattern are displayed separately to show their separate arrival times with time delays, calculated with j=0, of 1/(Nf) between arrivals. For the case of 8 arrays, which is illustrated in FIGS. 6 and 6A, this delay is therefore ⅛ of the period of the frequency f. When added together with this delay, energy at and near this frequency is array canceled out. If there were only two arrays, the delays between their initiations would have been chosen so that the two arriving wavetrains would have a delay between them of 1/(2f) or half the period of f for j=0, or 3/(2f) for j=+1, or −1/(2f) for j=−1. In either case, the two wavetrains will then arrive with the components of frequency f being 180° out of phase, so they will again largely cancel each other. In general, and particularly for wavetrains of short duration, the use of small values of j and the resulting short delay between arriving wavetrains can be expected to give the most effective vibration reduction. But the use of values of j having a larger absolute value, and the resulting longer delay times can be useful in improving blasting action if the shorter delay gives insufficient time for burden movement. This is more apt to occur when using explosives of relatively low detonation velocity, in which case the acceleration of the burden may be relatively low even though the final velocity of the burden may be relatively high.

When using blasting patterns comprised of multiple arrays, the patterns may be oriented at various angles to the quarry face, depending upon the blasting action desired, and multiple blasting patterns may also be used. For example, a V-cut blasting pattern can be obtained by placing two multi-array patterns side by side, timing the detonations of each array in accordance with this invention, and starting the initiation of each array with the detonator that is closest to both the quarry face and to the other array. These two detonators may be fired simultaneously or with a time delay between them that is no longer than the other time delays used in the blast.

In most cock blasting a maximum amount of rock fragmentation is desired. Others have established that this usually requires that $(T_m/S) \geqq 0.003$ seconds/meter. In view of this invention, which requires that $T_m=(L_m/D_m)+(Q_m/C)-(R_{m+1}/C)$, and in view of typical blasting situations where $(Q_m/C)-(R_{m+1}/C) << (L_m/D_m)$, it follows that this requirement for obtaining satisfactory blasting action can generally be met when practicing this invention if $D_m \leqq 333\ (L_m/S)$ meters/second. This is referred to as "the desired condition" in the examples. For a typical quarry blast, $(L/S)<5$. This implies that, unless the charges are unusually long for their diameter and spacing, it is preferred that $D<1665$ meters/second or less. The compositions disclosed in U.S. Pat. Nos. 5,071,496 and 5,099,763 are examples of blasting agents capable of detonating with velocities of 440meters per second or less and therefore are well suited for meeting this preferred condition. These low velocities are achieved by using a relatively small detonator to initiate a blasting agent which has been phlegmatized by pumping it through a hose while metering water into the hose through a circumferential orifice.

The effectiveness of the invention for reducing ground vibration increases with the accuracy and precision of the values of the variables used to calculate the delay times, and with the accuracy and precision with which the initiation system provides those delay times. The method of timing is not critical provided that it times the initiations with sufficient reliability, accuracy, and precision. The time delays that actually occur in a blast made in accordance with this invention will usually vary from the 1deal time delays due to errors in the quantities used to calculate the time delays, errors in the time delays themselves, or an inability of the initiation system to provide even nominal values of the calculated time delays. It is preferred that these various sources of error result in a departure of no more than 0.004 second from the value obtained for each of the delay times by calculation with error-free values of S, $L_m$, $R_{m+1}$, $Q_m$, C, $D_m$, and f. Therefore, practice of the invention requires good technique in surveying in and laying out the blasting pattern relative to outlying locations where vibration is to be reduced, in maintaining the geometry when drilling the boreholes and emplacing detonators and charges, in maintaining control of charge composition and density, and in obtaining reliable values of C, $D_m$, and f. In order that the initiation system contribute as little as possible to timing errors, it is desirable that it provide delay times that differ from the calculated values by no more than 0.004 second and preferably by no more than 0.001 second. In those cases where the timing method can provide only certain delay times, it may be possible to adjust the charge length, detonation velocity, hole spacing, or orientation of the hole pattern so as to make the delay times called for by the invention closer to those that can be provided by the initiation system.

The time delays may be provided, for example, by an initiation system that includes one or more components that might include pyrotechnic delay elements, pyrotechnic delay detonators, electronic delays, electronic delay detonators, an electronic or mechanical sequential timer, a central computer connected to the initiation system, shock-sensitive devices at or in the detonators or in the terminal ends of the charges, or lengths of low-velocity shock tube. In addition to the detonator required in each charge, other components of the initiation system can be variously located, depending upon the system used. Such locations can be at or in each detonator whose detonation is to be delayed, at the terminal end of each charge to be detonated previously, on the surface outside the boreholes, or on the surface away from the blast. Programmable precision electronic delay detonators are preferred means of producing delayed initiations in practicing this method. Examples of such detonators are those disclosed in U.S. Pat. Nos. 4,699,241 and 4,818,560, and also the "programmable millisecond delay detonator system" developed by Thiokol Corporation. In the latter system, each detonator contains an electronic delay circuit which can be programed to give a delay of up to 0.5 second in 0.001 second increments with a precision of +0.00025 second. A preferred alternative method involves the use of an electronic sequential blasting machine, such as that disclosed in U.S. Pat. No. 3,805,115, to initiate precise pyrotechnic delay detonators having relatively short delay times, wherein all the pyrotechnic delays have the same nominal delay time and all are from the same lot of manufacture, and the time delays between detonations are provided by the blasting machine.

Figure 7:
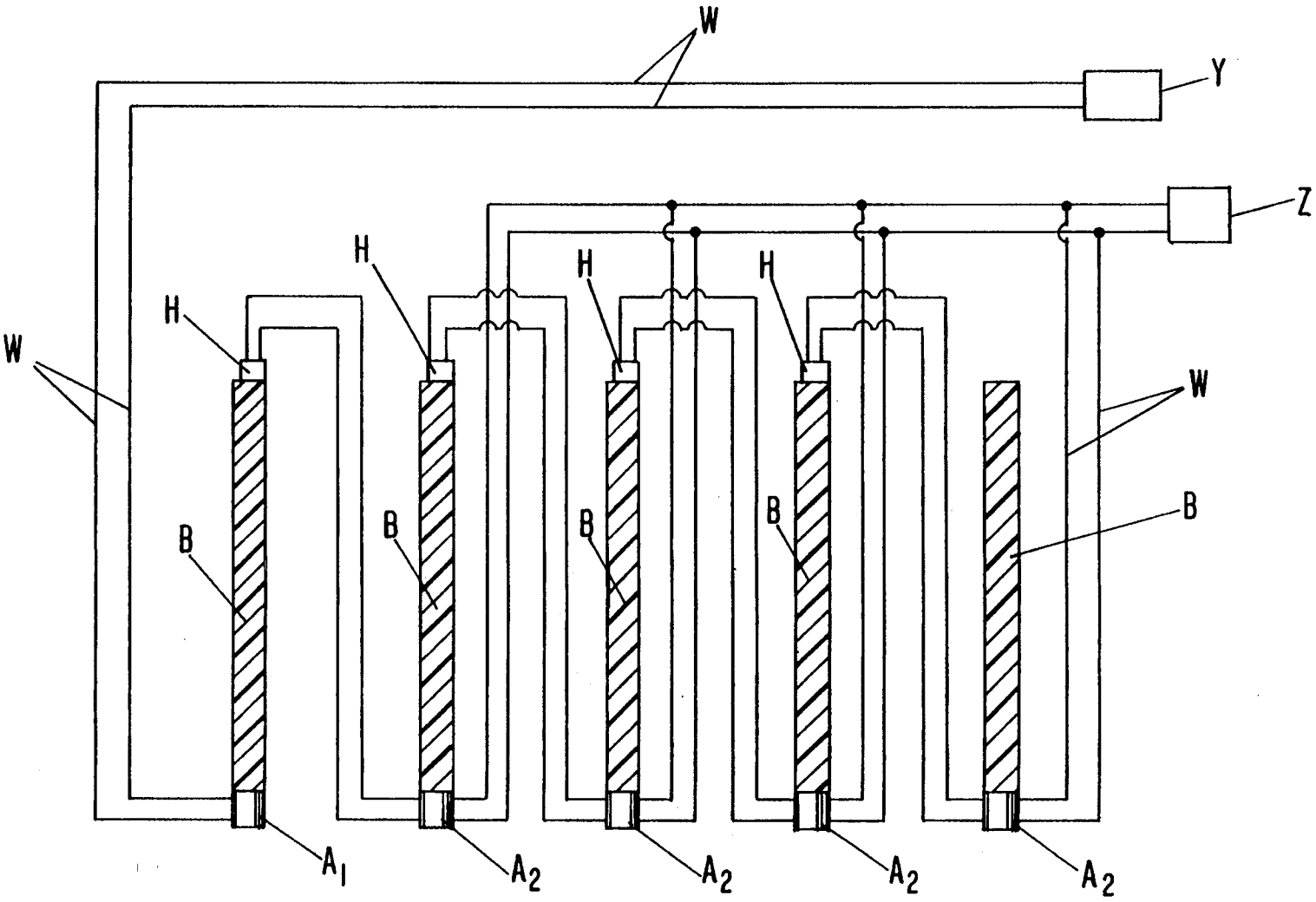
FIG. 7 is a schematic illustration of an array of charges in which a piezoelectric element, which is placed at the terminal end of each charge except the last charge, activates a pre-programmed electronic time-delay detonator in the next charge upon arrival of a detonation front at the terminal end of each charge except the last charge, the required total time delays thereby being obtained in spite of uncertainties in the detonation velocities of the charges.

In situations where the detonation velocities of the charges are variable or unpredictable, the initiation system within an array can be arranged to give the required delay times $T_m$ nevertheless. This embodiment of the invention is illustrated in FIG. 7, which illustrates an array of charges B having unknown or erratic detonation velocities. In this figure, $A_1$ is an electrically-fired detonator in the first charge to be detonated in the array. If the pattern contains only one array, $A_1$ may be an instantaneous detonator initiated by a simple blasting machine Y. If the pattern contains more than one array, $A_1$ is preferably an electronic delay in the first charge to be detonated in each array and Y is a blasting machine that starts the time delays in all the $A_1$ detonators simultaneously. Alternatively, $A_1$ is a pyrotechnic delay detonator in the first charge to be detonated in each array, all $A_1$ detonators being from the same batch of manufacture and having the same short pyrotechnic delay, and Y is a sequential blasting machine which sequentially initiates all the $A_1$ detonators. The detonator $A_2$ provided for each charge in the array, except the first charge, has associated with it a programmable electronic time-delay circuit set to close a normally-open electronic switch and thereby fire the detonator $(Q_m/C)-(R_{m+1}/C)$ seconds after the time-delay circuit is activated. A fast-acting piezoelectric pressure-sensitive element H is placed in or in contact with the terminal end of each charge in the array, except the last charge. The electrical output of each piezoelectric element H is connected to the electronic time-delay circuit associated with the detonator in the charge to be fired next, so that its piezoelectric output, if sufficient, will activate the delay circuit, which will then close the switch and thereby fire the detonator after the programed time delay. A capacitor associated with each time-delay circuit, which is chargeable from a power source Z located outside the borehole, powers each time-delay circuit and is also connected in series to each detonator through its electronic switch. The required electric leads, indicated in FIG. 7 by W, run into and out of the holes as required by the circuitry, but for clarity are shown running off to the sides of the charges. Each piezoelectric element, when compressed by a compression wave in the rock from a nearby detonation, produces insufficient electrical output to activate the time-delay circuit to which it is connected. But when compressed by the much higher pressure associated with the arrival of the detonation front at the terminal end of the charge in contact with it, it produces sufficient output to activate the time-delay circuit for the detonator in the next charge to be fired, thereby starting the programed time delay, after which the electronic switch is closed and the detonator fires. The resulting total time delay obtained between initiations of each pair of charges in the array is therefore the time required for detonation to consume the first charge of the pair, $L_m/D_m$, whatever the values of $L_m$ and $D_m$ turn out to be, plus the time delay previously programed into the detonator of the second charge of the pair. This sum is $T_m$. For charge pairs having the terminal charge directly above or below the detonator of the second charge, and where the outlying location is distant in an approximately horizontal direction from the charges, $Q_m=R_{m+1}$, so that the total time delay, $T_m$, is just $L_m/D_m$ and is provided by the piezoelectric elements alone and that part of the total delay time to be programed into the detonators is zero, so instantaneous detonators without delay circuitry can be used in this case. This situation occurs for charge pairs that are arranged one above the other in the same vertical hole and, as described previously, can also occur with charge pairs in adjacent tilted holes. The circuitry required to achieve the required functions of the blasting machines, piezoelectric elements, electronic time-delay circuits, electronic switches, capacitors and their charging circuits, final firing circuitry in the detonators, necessary safe arm and other safety and technical features of the overall initiation system, are well known to those skilled in the art and are therefore unnecessary to detail here. A piezoelectric pressure-sensitive element may comprise, for example, a body of lead-zirconate-titanate ceramic, which is also known as PZT, or of a piezoelectric polymer such as polyvinylidene fluoride, which is also known as PVDF, with electrodes formed on opposing surfaces of the body. This embodiment of the invention is distinctly different in a number of ways from the invention described in U.S. Pat. No. 4,699,241, which also utilizes piezoelectric elements. For example, in the present invention: (1) at least some, and usually all, of the charges are in separate holes, whereas in U.S. Pat. No. 4,699,241 they are all in the same hole; (2) the charges have elongated forms, whereas in U.S. Pat. No. 4,699,241 they have lump forms; (3) each piezoelectric element for a charge pair is in contact with the terminal end of the first charge of the pair to detonate, whereas in U.S. Pat. No. 4,699,241 they are close to the detonators in the other charges which are some distance away; and (4) a piezoelectric element, when compressed by the seismic wave of a nearby charge, produces insufficient electrical output to activate the time delay circuit of the detonator in the next charge or to produce any other function, whereas in U.S. Pat. No. 4,699,241 the piezoelectric element activates the time-delay circuit in response to a seismic wave. This embodiment of the invention is also distinctly different in a number of ways from the invention described in U.S. Pat. No. 4,976,199, which also utilizes piezoelectric elements. For example, in the present invention: (1) the time required for detonation to consume a charge is an essential variable used in setting the time delays between initiations of charges in an array, whereas in U.S. Pat. No. 4,976,199 this variable is not used; (2) when the blasting pattern comprises more than one array, the number of arrays is an essential variable used in setting the time delays between successive initiations of arrays, whereas in U.S. Pat. No. 4,976,199 this variable is not used; (3) piezoelectric elements are located far from any detonators, at the terminal ends of the first charge of each pair of charges in an array, whereas in U.S. Pat. No. 4,976,199 the piezoelectric elements are placed at or near the detonators; (4) piezoelectric elements are used to detect the times of arrival of detonation fronts at the terminal ends of charges, whereas in U.S. Pat. No. 4,976,199 piezoelectric elements are used to determine the arrival times and forms of vibrations that have travelled through the formation from detonations of charges located elsewhere; and (5) the delay times between detonations of charges in an array required by this embodiment of the invention are precisely produced in the course of a blast without complex signal processing, computing, or programming electronic time delays during the course of the blast, whereas in U.S. Pat. No. 4,976,199 all of these things are done, and they are done in a way that will result in time delays that are different from those of the present invention.

FIGS. 1, 3, 4, 5, 5A, 6 and 7, which illustrate the presence of detonators, do not in all cases explicitly show the additional assumed presence of other paraphenalia such as wires or timing devices or details of circuits used to provide delays or firing signals to the detonators. Where they are required, the presence of such items is to be understood from the context of the discussion.

EXAMPLE 1

A pattern comprising a single array of 15 vertical boreholes 150 mm in diameter and 16 m deep are drilled on 4.0 m spacings in a straight line bearing 30° true and 4 m behind a vertical face 16.5 m high. A neighbor who has complained about ground vibration from blasting at this operation lives in a house that bears 30° true at a range of 1100 m from the center of the array on ground having the same elevation as the top of the charge. The array is to be shot starting with the detonator which is farthest from the house. The bottom of each borehole is provided with a pyrotechnic 100 ms delay detonator, all of the same lot, which is wired to a sequential blasting machine. The primer used with each detonator is sized in accordance with the teachings of U.S. Pat. No. 5,071,496. Each borehole is then loaded with a 14.5 m column of a blasting agent made in accordance with the teachings of this same patent and having a detonation velocity of 450 m/sec. The velocity of sound in the rock containing the charges is known to be 5600 m/sec. From the above data, one has:

$S=4.0$ m;
$L=L_m=14.5$ m;
$R=R_m=1100.1$ m;
$R_{m+1}=1096.1$ m;
$Q=Q_m=1100.0$ m;
$C=5600$ m/sec;
$D=D_m=450$ m/sec.

Requirement 1 is met as follows:
$(C/D)>(R/L)-(Q/L)$,
or:
$(5600/450)>(0.1/14.5)$.

Requirement 2 is met as follows:
$(C/D_m)>(R_{m+1}/L_m)-(Q_m/L_m)$,
or:
$(5600/450)>(-3.9/14.5)$.

The desired condition is met as follows:
$D\leqq 333\ (L/S)$,
or:
$450\leqq 333\ (14.5/4.0)$.

So:
$T_m=(L_m/D_m)+(Q_m/C)-(R_{m+1}/C)$
$=(14.5/450)+(3.9/5600)$
$=0.0329$ sec.

Therefore the array is shot with the sequential timer set to give delays of 33 ms between initiations, Vibration with a peak particle velocity of only 3 mm/sec is recorded next to the house. Had the array been shot beginning at the other end, $Q_m-R_{m+1}$ would have reversed sign and the calculated time delays would have been 0.0315 sec.

EXAMPLE 2

A pattern comprising a single array of 20 vertical boreholes 150 mm in diameter and 80.0 m deep are drilled on 3.5 m spacings in a straight line bearing 100° true, parallel to, and 4.0 m behind, a vertical face 79.4 m high. A historic building at which ground vibration is to be minimized is located in front of the quarry face bearing 10° true at a range of 650 m from the center of the array, at the same elevation as the bottom of the charge. The bottom of each borehole is provided with a 100 ms pyrotechnic delay detonator connected to an electronic sequential blasting machine, all delay detonators being from the same lot. Each borehole is loaded with a 78.0 m column of ammonium nitrate/fuel oil having a detonation velocity of 5000 m/sec in holes of this diameter. The velocity of sound in the rock containing the blasting pattern is 5500 m/sec. The above data give:

$S=3.5$ m;
$L=L_m=78.0$ m;
$R=R_m=650$ m;

$$Q = Q_m = 78.1 \text{ m down to the toe} + 646 \text{ m over to the building} = 724.1 \text{ m};$$

$C=4500$ m/sec;
$D=D_m=5000$ m/sec.

Requirement 1 is met as follows:
$(4500/5000)>(650.0/78.0)-(724.1/78.0)$.

Requirement 2 is met as follows:
$(4500/5000)>(650.0/78.0)-(724.1/78.0)$.

The desired condition is met as follows:
$500\leqq 333\ (78.0/3.5)$.

So:

$$T_m = (78.0/5000) + (724.1/4500) - (650.0/4500) = 0.0321 \text{ sec.}$$

Therefore the array is shot with the sequential timer set for 32 ms between successive initiations of the charges in order of their position in the array, beginning at the western end. The peak particle velocity of the vibration recorded next to the historic structure is only 5 mm/sec. In this case, initiation beginning at the eastern end of the array would have given essentially the same result because the outlying location, i.e. the structure, lies at 90° to the line of the array.

EXAMPLE 3

A pattern of boreholes is drilled comprising 5 parallel and equally spaced arrays of holes 150 mm in diameter and 20.0 m long. Each array of holes comprises 30 holes on 4.0 m spacings in a straight line bearing 60° true with each hole tilted by an angle $\phi=12.5°$ from the vertical toward 240° true. Therefore the bottom of each hole, except the first hole, is directly under a point 18.5 m above it that will be occupied by the top of an 18.5 m long charge in the previous hole whose collar bears 240° from it. Behind the face, the quarry is encroached on by a village, with houses in all directions within a 180° arc from the blasting pattern, the closest being behind the face at a range of 700 m bearing 5° true from the center of the pattern of holes. Through the use of tilted boreholes, each array is therefore designed to generate minimum vibration in all directions toward the village when the southwesterly end of the array is initiated first. The hole collars of the first array are in a line parallel to and 3.5 m behind a quarry face that is 19.5 m high. The other arrays are directly behind and aligned with the first array, with 3.5 m spacings between arrays and with the bottoms of the first hole in each array all lying on the same straight horizontal line bearing 330° true. The bottom of each hole is provided with an electronic delay detonator programmable in 1 ms increments of delay with an accuracy of± 0.25 ms, which are connected to a blasting machine capable of arming and then starting the time delays in these detonators. The primer used with each detonator is sized in accordance with the teachings of U.S. Pat. No. 5,071,496. Each borehole is loaded with an 18.5 m column of a blasting agent made in accordance with the teachings of this same patent and having a detonation velocity of 510 m/sec. The velocity of sound in the rock containing the blasting pattern is 4500 m/sec. Detonation of a single array, using time delays in accordance with the calculation of $T_m$ given below, produces ground vibration at the closest house having starting and ending transients for which f=7.7 Hz.

For ground vibration produced at sufficiently distant locations, the time delays calculated for representative pairs of charges can be used for all similarly spaced and oriented pairs of charges aligned in the same direction. But for outlying locations close to the blast, where the dimensions of the charges or pattern of holes are not small compared to the distance to the location, the calculated delay times may vary appreciably from hole pair to hole pair, and the individually-calculated delay times are then used. In these examples, it is assumed that they do not vary appreciably.

From the above data and making the calculations for initiation of the array at its southwestern corner, one has:

$S=4.0$ m;
$L=L_m=18.5$ m;
$R=R_m=R_{1,k}=(700^2+18.5^2)^{\frac{1}{2}}=700.24$ m;
$R_{m+1}=700.24-4.0\cos(60°-5°)=697.95$ m;
$R_{1,k+1}=700.24-3.5\sin(60°-5°)=697.37$ m;
$Q=Q_m=700.00$ m;
$N=5$;
$C=4500$ m/sec;
$D=D_m=510$ m/sec;
$f=7.7$ Hz.

Requirement 1 is met as follows:
$(4500/510)>(700.24/18.5)-(700.00/18.5)$.
Requirement 2 is met as follows:
$4500/510>(697.95/18.5)-(700.00/18.5)$.
The desired condition is met as follows:
$510\leqq-333\ (18.5/4.0)$.

So:

$T_m=(18.5/510)+(700.00/4500)-(697.95/4500)=0.0367$ sec, and $$\begin{aligned} T_k &= (R_{1,k}/C)-(R_{1,k+1}/C)\pm[(N^{-1}+j)/f] \\ &= (700.24/4500)-(699.37/4500)\pm \\ &\quad [(5\cdot 7.7)^{-1}+(j/7.7)] \end{aligned}$$

Therefore, considering only positive calculated values of $T_k$:

for j=O, $T_k=0.0006\pm0.0260=0.0266$ sec;
for j=+1, $T_k=0.0006\pm0.1559=0.1565$ sec;
for j=−1, $T_k=0.0006\pm0.1039=0.1045$ sec;
for j=+2, $T_k=0.0006\pm0.2857=0.2863$ sec;
for j=−2, $T_k=0.0006\pm0.2338=0.2344$ sec, etc,.

The 0.0266 second solution, although the best one for reducing vibration because it is for j=0, is considered to be too short to allow a sufficient amount of movement of the rock between detonations of arrays. The 0.1045 second solution is chosen because it is the one using the smallest absolute value of j that gives enough delay time for adequate burden movement between rows. Therefore the pattern is shot using $T_m=37$ ms between successive initiations of charges in each array and 104 ms between successive initiations of arrays. Peak ground vibration of only 2 mm/sec is recorded at the closest house and no complaints about vibration are received. Had none of the calculated values of $T_k$ been found suitable, redesigning the blast for a different value of N would have provided another set of different choices. Other variations in design that can give timings having improved blasting action in some cases entail shooting the arrays beginning at the other end with timing recalculated for this arrangement, or turning the hole pattern 90° so that the arrays are perpendicular to the quarry face. When the array is turned, the time delays between initiations of adjacent arrays are the time delays between successive initiations of adjacent charges in rows parallel to the face, and successive initiations of adjacent charges in an array are the time delays between successive initiations of adjacent rows of charges beginning with the row closest to the face.

EXAMPLE 4

A pattern comprising 18 parallel arrays of vertical boreholes, with each array comprising 12 boreholes having their collars in a straight line oriented north-south to a quarry face oriented east-west are drilled to a depth of 12.5 m and are to be loaded with charges of explosives 11.0 m long. All boreholes in an array, except the first and last, are 150 mm in diameter on 4.0 m spacings. The first and last boreholes are only 100 mm in diameter and are 3.0 m from the adjacent hole in the array. On one end of each array the 100 mm holes are 3 m from the east-west quarry face. The easternmost array is parallel to, and 4 m from, another quarry face oriented north-south. All arrays are on 4.2 m spacings from each other. The pattern is to be initiated beginning at the southeastern corner. A microchip manufacturing plant containing equipment and operations which are very sensitive to vibration is located 1500 meters directly north of and behind the east-west quarry face. The blasting agent to be used is a formulation having a density of 1.30 made in accordance with the teachings of U.S. Pat. No. 5,071,496, and is to be initiated with a detonator, including primer, sized in accordance with this same patent. Detonation velocities of 510 m/sec in the 150 mm holes and 450 m/sec in the 100 mm holes are to be obtained. A 10 kg test charge is shot in the vicinity of the pattern in a 150 mm diameter hole and the ground vibration that it produces next to the plant is detected with a geophone and recorded with a digitally recording seismograph of high sensitivity. The velocity of sound in the rock is found to be 4050 m/sec by measuring the times of arrival at transducers in nearby holes of compression waves from detonation of the test charge. The vibration to be expected at the plant from a single array is then calculated, this vibration being the same as that from a single 132.0 m column of explosive, its first 11.0 m and last 11.0 m being 100 mm in diameter and detonating at 450 m/sec and consuming explosive at a rate of 4.6 kg/ms, and its middle 110.0 m being 150 mm in diameter and detonating at 510 m/sec and consuming explosive at a rate of 11.7 kg/msec, with seamless splices between the arriving wavetrains from the successive terminations and initiations of detonation. It is assumed that each increment of explosive mass consumed in 1 ms will contribute to the ground vibration in proportion to its mass to the 0.785 power, in accordance with well-known experimental results obtained with separate test charges having various masses. Therefore the contribution to the vibration by a 1 ms charge increment of this composition in a 100 mm hole relative to that in a 150 mm hole, will be a factor of $(4.6/11.7)^{0.785}=0.48$. And the contribution by a 1 ms charge increment of this composition in a 150 mm hole relative to that of the total vibration recorded for the 10 kg test charge will be a factor of $(11.7/10.0)^{0.785}=1.13$. To the nearest millisecond, each of the 11.0 m lengths of charge in the 100 mm holes will take 24 ms to detonate and the 110 m length of charge in the 150 mm holes will take 216 ms to detonate. Therefore, in order to synthesize the expected form of the vibration that will arrive at the plant from the detonation of one array timed in accordance with the invention, $(24+216+24)=264$ copies of the waveform recorded from the 10 kg test charge, separately for each of the vibration components and their vector sum, are added together with 1 ms time delays between them and with the first 24 and last 24 copies changed in amplitude by a factor of $1.13 \cdot 0.48=0.54$ and the middle 216 copies changed in amplitude by a factor of 1.13. In this case, the resulting four synthetic waveforms, for all three components of the vibration and their vector sum, exhibit starting and ending transients with little vibration between them, and a value of f of 8.3 Hz. Each borehole is loaded with an electronic delay detonator and primer of the required size at the base of each charge. Each hole is then stemmed with 1.5 m of aggregate. For this example, and to a sufficient degree of approximation:

$S_1=4.0$ m;
$S_2=3.0$ m;
$L_m=11.0$ m;
$N=18$;
$C=4050$ m/sec;
$D_m=450$ m/sec for the first and last charges in each array;
$D_m=510$ m/sec for all the other charges;
$f=8.3$ Hz;

for calculating the delays between the first two and last two charges of each array:

$Q=Q_m=R=R_m=R_{m+1}+3.0$ m;

for calculating all the other delays in each array:

$Q=Q_m=R=R_m=R_{m+1}+4.0$ m;

for calculating the delays between successive initiations of arrays:

$R_{1,k}=R_{1,k+1}$.

Requirement 1 is met as follows:

$(4050/450)>0$ and $(4050/510)>0$.

Requirement 2 is met as follows for the first, last, and other delays in an array, respectively:

$(4050/450)>(-3.0/11.0)$,
$(4050/510)>(-3.0/11.0)$,
$(4050/510)>(-4.0/11.0)$.

The desired condition is met as follows for the second charge, the last charge, and the intervening charges in an array, respectively:

$510 \leqq 333\ (11.0/3.0)$,
$450 \leqq 333\ (11.0/3.0)$,
$510 \leqq 333\ (11.0/4.0)$.

So $T_m$ for the first, last, and intervening delays in an array are, respectively:

$(11.0/450)+(3.0/4050)=0.0252$ sec,
$(11.0/510)+(3.0/4050)=0.0223$ sec,
$(11.0/510)+(4.0/4050)=0.0226$ sec.

$T_k$, the time delay between initiations of the first detonator in each array is given by:

$\pm\{[1/(18 \cdot 8.3)]+[j/8.3]\}$.

Therefore, considering only positive values for this expression, possible values for $T_k$ for the 5 values of j having the smallest absolute value are:

for $j=0$, $T_k=\pm(0.00669+0)=0.0067$ sec;
for $j=+1$, $T_k=\pm(0.00669+0.12048)=0.1272$ sec;
for $j=-1$, $T_k=\pm(0.00669-0.12048)=0.1138$ sec;
for $j=+2$, $T_k=\pm(0.00669+0.24096)=0.2477$ sec;
for $j=-2$, $T_k=\pm(0.00669-0.24096)=0.2343$ sec.

The value for $j=0$ is chosen. The shot is made with 25, 22, and 23 ms, respectively, for the first, last, and intervening delays in each array and with 7 ms for the delays between successive initiations of the first detonator in each array. Peak ground vibration of 1 mm/second is recorded next to the plant.

EXAMPLE 5

A pattern comprising one array of vertical boreholes 150 mm in diameter are to be drilled on 4.0 m spacings to a depth of 5.0 m with the collars of the holes lying on a straight line oriented 90° true and 4 m north of a quarry face. Ground vibration is to be minimized at a location bearing 80° true at a range of 1000 m from the center of the pattern. Each hole is to be loaded first with a delay detonator, including a primer, and then with a charge of ammonium nitrate/fuel oil 3.5 m long and having a detonation velocity of 5000 m/sec. The velocity of sound in the rock near the planned blast is 4000 m/sec. The charges are to be detonated in order of their positions in the array, with the easternmost charge detonated first. For this example, to a degree of approximation such that more accurate calculation will not change the conclusions, one has:

$S=4.0$ m;
$L=L_m=3.5$ m;
$Q=Q_{m=R=Rm}$;
$R_{m+1}-Q_m=4.0\cos(90°-80°)=+3.9$ m;
$C=4000$ m/sec;
$D=5000$ m/sec.

Requirement 1 is met as follows:

$(4000/5000)>(0/3.5)$.

But Requirement 2 is not met, as the following relationship shows:

$(4000/5000)<(3.9/3.5)$.

The desired condition is also not met, as the following relationship shows:

$5000>333\ (3.5/4.0)$.

The requirement that the expression for $T_m$ be positive is not met:

$T_m=(3.5/5000)-(3.9/4000)=-0.0003$ sec.

Therefore this blast, as planned, will not satisfy the conditions required by the invention. If the charges were to be detonated starting with the other end of the array, the blast could satisfy both requirements 1 and 2 for obtaining low vibration. Then $T_m$ would be positive, but only 0.0017 sec. The desired condition for good fragmentation would still be unsatisfied.

I claim:

1. A method of blasting a geological formation so as to result in reduced ground vibration at an outlying location, said method comprising the steps of:

a) drilling one or more arrays of boreholes into the formation;

b) emplacing explosives in the boreholes to form one or more arrays of elongated charges and in the process of emplacing the explosive charges also placing a detonator in each charge that is capable of initiating detonation in it, where the detonator is placed close to an end or the midpoint of the charge, and where for each charge the following relationship is satisfied:

$$(C/D)>(R/L)-(Q/L)$$

where D is the detonation velocity of the explosive, C is the velocity of sound in the formation near the charge, L is the length of the charge from the location of the detonator to the end of the charge where detonation ceases, R and Q are, respectively, the shortest distances through the formation to the outlying location from the location of the detonator and from the end of the charge where detonation ceases, and where this relationship is satisfied for both halves of the charge when the detonator is placed close to its midpoint;

c) providing means for setting accurate time intervals between the firings of the detonators;

d) choosing and then setting time intervals for the firings of the detonators such that the detonators in each array are fired in succession from one end of the array to the other, where the time interval $T_m$, in seconds, between the firing of the detonator in each charge m and the immediately succeeding firing of the detonator in charge (m+1) in the same array satisfies the following relationship:

$$T_m=(L_m/D_m)+(Q_m/C)-(R_{m+1}/C)<0$$

where $L_m$, $D_m$, and $Q_m$ are, respectively, the values of L, in meters, D, in meters per second and Q, in meters, for charge m, $R_{m+1}$ is the value of R, in meters, for charge (m+1), and C is in meters pep second; and e) firing the detonators in each array with time intervals $T_m$ between firings;

f) and when there is more than one array, making them all of essentially the same design, all adjacent to each other and approximately equally spaced apart, all with approximately the same orientations, all with the detonators of the first charge to be detonated in each array lying on or close to the same straight line, with the detonators in each array being fired with time intervals between firings so as to give all of the arrays essentially the same overall duration of detonation from start to finish, where the arrays are initiated in direct or inverse order of the positions of the detonators on said straight line, and where the time intervals $T_k$ between successive initiations of the first charge in each array are all made to be essentially equal to the same positive value, in seconds, of the following expression:

$$T_k=(R_{1,k}/C)\pm[(N^{-1}+j)/f]$$

where $R_{1,k}$ and $R_{1,k+1}$ are, respectively, the distances in meters to the outlying location from the location of the first detonator to be fired in one of the arrays and from the first detonator to be fired in the next array to be initiated, N is the number of arrays, j is zero or a positive or negative integer having an absolute value not larger than 4, and f is a frequency, in Herz,at which there is a relatively high peak in the power or amplitude spectrum of the ground vibration that would arrive at the outlying location due to the detonation of one array alone or, alternatively, where f is the instantaneous frequency at the time of occurrence of a relatively high peak in the amplitude of one of the three components of the ground vibration or of their vector sum for the ground vibration that would arrive at the outlying location due to the detonation of one array alone.

2. A method of claim 1 wherein j is zero or a positive or negative integer having an absolute value not larger than 2.

3. A method of claim 1 wherein the accuracy of control and determination of the geometry of the charge arrangement, of charge and detonator positions relative to the position of an outlying location where vibration is to be reduced, of the velocities of detonation and of sound in the formation adjacent to the blast, and of timing of the initiation systems are sufficiently high to provide time intervals between initiations that differ by no more than 0.004 second from those that would be calculated without error.

4. A method of claim 1 wherein the time intervals between initiations are provided by a system in which each detonator contains electronic delay circuitry that can be programed to give desired time intervals in increments of 0.001 second or less, with an accuracy of 0.0005 second or less.

5. A method of claim 1 wherein the time intervals between initiations are provided by a system in which each detonator contains a pyrotechnic delay element and these are ignited by signals from electronic timing circuitry that can be programmed to give desired time intervals in increments of 0.001 second or less with an accuracy of 0.0005 second or less, said electronic timing circuitry being distant from the detonators but connected to them by wires, optical fibers, radio or microwave transmission.

6. A method of claim 1 wherein the explosive has a velocity of propagation in the range of about 3000–7000 meters per second.

7. A method of claim 1 wherein the explosive has a velocity of propagation in the range of about 1000–3000 meters per second.

8. A method of claim 1 wherein the explosive has a velocity of propagation in the range of about 200–1000 meters per second.

9. A method of claim 1 wherein the explosive has a velocity of propagation in the range of about 200–1000 meters per second, which is achieved by phlegmatizing a blasting agent by adding water to it.

10. A method of claim 1 wherein the explosive has a velocity of propagation in the range of about 200–1000 meters per second, which is achieved by phlegmatizing a blasting agent by adding water to it and initiating it with a primer having sufficient strength to cause the entire charge to detonate at a velocity no greater than 1000 meters per second but of insufficient strength to cause it to detonate at a velocity greater than 1000 meters per second.

11. A method of claim 1 wherein the explosive has a velocity of propagation in the range of about 200–1000 meters per second, which is achieved by phlegmatizing a blasting agent by pumping it into a borehole through a hose into which water is metered in a circumferential stream in sufficient amounts to phlegmatize the explosive so that it will detonate at a constant low velocity if not initiated with too large a primer, and by initiating the phlegmatized explosive with a primer having sufficient strength to cause the entire charge to detonate at a velocity no greater than 1000 meters per second but of insufficient strength to cause it to detonate at a velocity greater than 1000 meters per second.

12. A method of claim 1 wherein the final portion of the charge may extend to the collar of the hole, thereby replacing the inert stemming that is otherwise used to seal the mouth of the borehole, if the detonation velocity of the charge is less than 1200 meters per second and the detonator for the charge is placed at its bottom or midpoint.

13. A method of claim 1 wherein the time delays between initiations are provided by programmable electronic delay circuitry contained in each detonator that fires after the first detonator to fire.

14. A method of claim 1 wherein the required delay times between initiations of charges in an array can be obtained without knowledge of the precise velocities with which the individual charges will detonate, wherein a piezoelectric element is placed at the terminal end of the first charge, m, to be detonated of each pair of charges m and (m+1) in the array, and the output of the piezoelectric element, upon arrival of the detonation front at the terminal end of charge m, activates a programmable electronic delay detonator located in the second charge (m+1) of the pair, thereby initiating charge (m+1), where the delay programmed into the delay detonator of charge (m+1) is $(Q_m/C)-(R_{m+1})$ and where each piezoelectric element produces insufficient output to activate the delay detonator in the next charge in response to seismic waves from the detonation of other nearby charges.

15. A method of claim 1 wherein up to three of the first and up to three of the last charges to be detonated in each array generate explosive power at rates that are 10% to 90% of the rates of the nest of the charges in the array, with the first charges being detonated in ascending order of explosive power and the last charges being detonated in descending order of explosive power, the explosive power of a charge being defined as $(\pi/4)d^2De$ calories/second where D is the detonation velocity in meters/second, e is the amount of energy available in each unit roll the Of explosive in calories/cubic centimeter and d is the diameter of the borehole in millimeters, and where the explosive power of a charge may be reduced by reducing its diameter, its density, or its energy per unit volume, or some combination of them.

16. A method of claim 1 wherein the detonators that initiate up to three of the first and up to three of the last charges in each array are placed at or near one end of these charges and the detonators that initiate the remaining charges in each array are placed at or near the midpoints of these charges.

17. A method of claim 1 wherein, in each array, the charges are tilted from the vertical direction so as to place the detonator of each charge in the array, with the exception of the first charge to be detonated in the array, in a position vertically above or below the terminal end of the charge to be detonated just previously in the array, and where the time intervals between successive initiations of the charges in the array are equal to $(L_m/D_m)$ where $L_m$ is the length of the charge that is initiated at the beginning of a time interval between successive initiations and $D_m$ is its detonation velocity, and where the first and last charges in the array may be untitled and shorter than the other charges.

18. A method of claim 1 wherein, for each pair of charges m and (m+1) that detonate in succession in an array, $D_m \leqq 333\ (L_m/S)$ meters per second where S is the spacing between charges m and (m+1).

* * * * *

UNITED STATES PATENT AND TRADEMARK OFFICE

CERTIFICATE OF CORRECTION

PATENT NO. : 5,388,521

DATED : Feb. 14, 1995

INVENTOR(S) : David L. Coursen

It is certified that error appears in the above-indentified patent and that said Letters Patent is hereby corrected as shown below:

There were no italicized symbols shown in the patent application and there should be no italicized symbols in the issued patent. This holds for all the symbols (A, B, C, c, D, d, E, e, F, f, G, H, i, j, k, L, M, m, N, n, P, Q, R, S, T, t, V, W, Y, Z, and 0, 1, 2, 3), whether used in the text or in the equations, and whether shown on the line or as subscripts. As issued, the patent is inconsistent, sometimes using italicized and sometimes un-italicized forms of the same symbol, thereby leaving a question as to whether the same variable is meant. Of the very many corrections of this kind, only some are specifically indicated below, with the other corrections.

In the Abstract, right-hand column, line 16, the phrase reading "All arrays ape designed" should read -- All arrays are designed -- .

At column 2, line 61, the last term of the equation, which is written "(OIL)" should be written -- (Q/L) --. The correct equation is:

$$(C/D) > (R/L) - (Q/L)$$

At column 3, lines 9 and 10, there should be no + sign directly in front of the > sign, and the symbols in the equation should not be italicized. The correct equation is:

$$T_m = (L_m/D_m) + (Q_m/C) - (R_{m+1}/C) > 0$$

for $m = 1,2,3,- - - (n - 1)$

UNITED STATES PATENT AND TRADEMARK OFFICE

CERTIFICATE OF CORRECTION

PATENT NO. : 5,388,521

DATED : Feb. 14, 1995

INVENTOR(S) : David L. Coursen

It is certified that error appears in the above-indentified patent and that said Letters Patent is hereby corrected as shown below:

At column 3, lines 30 and 31, the symbols should not be italicized. The correct equation is:

$$T_k = (R_{1,k}/C) - (R_{1,k+1}/C) \pm [(N^{-1} + j)/f] > 0$$

for $k = 1,2,3,- - -,(N - 1)$

At column 3, line 63, the phrase reading "the Pate of change" should read -- the rate of change --.

At column 4, line 63, the phrase reading "any cap sensitive booster charge" should read -- any cap-sensitive booster charge --.

At column 6, line 7, the portion of the line reading "sitions: being" should read -- sitions being --.

At column 6, both at line 28 and line 35, the symbol "O" should be -- Q --.

At column 6, lines 38, 42, 44, and 56, the subscript of t, where shown to be the letter "o", should instead be the numeral -- o --. This correction should also be made at column 7, lines 20, 24, and 46, and at column 8, lines 18 and 19.

At column 6, line 44, the phrase "denerated by a charge" should read -- generated by a charge --.

At column 7, line 68, the phrase "for. C, Ray path" should read -- for C. Ray path --.

UNITED STATES PATENT AND TRADEMARK OFFICE

CERTIFICATE OF CORRECTION

PATENT NO. : 5,388,521

DATED : Feb. 14, 1995

INVENTOR(S) : David L. Coursen

It is certified that error appears in the above-indentified patent and that said Letters Patent is hereby corrected as shown below:

At column 8, line 10, the left side of the equation, shown as "t", should be -- $\Delta t$ --. The correct equation is:

$$\Delta t = (L/D) + (Q/C) - (R/C)$$

At column 8, line 43, the phrase "detonations, FIG. 3" should read -- detonations. FIG. 3 --.

At column 8, lines 61 and 62, the symbols should not be italicized. The correct equation is:

$$T_m = (L_m/D_m) + (Q_m/C) - (R_{m+1}/C) > 0$$

for $m = 1,2,3,- - - (n-1)$

At column 9, line 2, the letter O in the expression "$T_n$ > O" should be replaced with the numeral 0. the correct expression is:

$$T_n > 0$$

At column 9, line 3, the symbols should not be italicized. The correct equation is:

$$(C/D_m) > (R_{m+1}/L_m) - (Q_m/L_m)$$

At column 9, line 32, the phrase "by an angle $\phi$ from the" should read -- by an angle $\theta$ from the --.

At column 9, line 34, the symbol " $\phi$ " should be replaced with the symbol -- $\theta$ --. The correct equation is:

$$\theta = \arcsin(S/L)$$

UNITED STATES PATENT AND TRADEMARK OFFICE

CERTIFICATE OF CORRECTION

PATENT NO. : 5,388,521

DATED : Feb. 14, 1995

INVENTOR(S) : David L. Coursen

It is certified that error appears in the above-indentified patent and that said Letters Patent is hereby corrected as shown below:

At column 11, lines 23 and 24, the symbols should not be italicized. The correct equation is:

$$T_k = (R_{1,k}/C) - (R_{1,k+1}/C) \pm [(N^{-1}+j)/f] > 0$$

for $k = 1,2,3,- - -,(N-1)$

At column 13, line 3, the phrase "this frequency is array" should read -- this frequency is largely --.

At column 13, line 36, the phrase "In most cock blasting" should read -- In most rock blasting --.

At column 14, line 50, the expression "of +0.00025 sec-" should read -- of ±0.00025 sec- --.

At column 15, lines 50 and 51, the expression "having the terminal charge directly" should read -- having the terminal end of the first charge directly --.

At column 18, line 41, the phrase "by an angle $\phi = 12.5^0$ " should read -- by an angle $\theta = 12.5^0$ --.

At column 19, line 37, there should be no minus sign in front of the right-hand term of the expression. The correct expression is:

$$510 \leq 333(18.5/4.0)$$

UNITED STATES PATENT AND TRADEMARK OFFICE

CERTIFICATE OF CORRECTION

PATENT NO. : 5,388,521

DATED : Feb. 14, 1995

INVENTOR(S) : David L. Coursen

It is certified that error appears in the above-indentified patent and that said Letters Patent is hereby corrected as shown below:

At column 19, lines 39 and 40, the part of the expression " = 0.0367 sec " should not be split between lines 39 and 40, but should all be on line 40.

At column 19, lines 44, 45, and 46, the symbols should not be italicized and the " ± " at the end of line 45 should be moved to the beginning of line 46. The correct equations are:

$$T_k = (R_{1,k}/C) - (R_{1,k+1}/C) \pm [(N^{-1} + j)/f]$$

$$= (700.24/4500) - (699.37/4500) \pm [(5 \cdot 7.7)^{-1} + (j/7.7)]$$

At column 19, line 50, the letter O should be replaced with the numeral 0, the phrase "for j = O" thereby being replaced with the phrase -- for j = 0 --.

At column 23, line 22, in claim 1, which is the most important claim, the right-hand side of the equation, " < 0 " should be replaced with -- > 0 --. The correct equation is:

$$T_m = (L_m/D_m) + (Q_m/C) - (R_{m+1}/C) > 0$$

At column 23, line 46, again in claim 1, which is the most important claim, the term -- $-(R_{1,k+1}/C)$ -- was omitted from the equation, and the variables should not be italicized. The correct equation is:

$$T_k = (R_{1,k}/C) - (R_{1,k+1}/C) \pm [(N^{-1}+j)/f]$$

UNITED STATES PATENT AND TRADEMARK OFFICE

CERTIFICATE OF CORRECTION

PATENT NO. : 5,388,521

DATED : Feb. 14, 1995

INVENTOR(S) : David L. Coursen

It is certified that error appears in the above-indentified patent and that said Letters Patent is hereby corrected as shown below:

At column 25, line 25, in claim 15, the phrase "of the nest of the charges" should be replaced with the phrase -- of the rest of the charges --.

At column 26, line 25, in claim 17, the phrase "untitled and shorter" should be replaced with -- untilted and shorter --.

Signed and Sealed this

Twenty-sixth Day of March, 1996

*Attest:*

*Attesting Officer*

Bruce Lehman

BRUCE LEHMAN

*Commissioner of Patents and Trademarks*